US008632111B2

(12) United States Patent
Krijnen et al.

(10) Patent No.: US 8,632,111 B2
(45) Date of Patent: Jan. 21, 2014

(54) APPARATUS AND METHOD FOR FACILITATING HANDLING PIPE

(75) Inventors: Anton Krijnen, Klundert (NL); Neils DeKeijzer, Etten-Leur (NL); Rene Mulder, Etten-Leur (NL); Joe Berry, Cypress, TX (US)

(73) Assignee: Varco I/P, Inc., Houston, TX (US)

( * ) Notice: Subject to any disclaimer, the term of this patent is extended or adjusted under 35 U.S.C. 154(b) by 1450 days.

(21) Appl. No.: 10/537,638

(22) PCT Filed: Aug. 9, 2004

(86) PCT No.: PCT/GB2004/003431

§ 371 (c)(1),
(2), (4) Date: Nov. 20, 2007

(87) PCT Pub. No.: WO2005/059299

PCT Pub. Date: Jun. 30, 2005

(65) Prior Publication Data

US 2008/0136203 A1 Jun. 12, 2008

Related U.S. Application Data

(63) Continuation-in-part of application No. 10/807,641, filed on Mar. 23, 2004, now Pat. No. 6,997,265, which is a continuation-in-part of application No. 10/734,923, filed on Dec. 12, 2003, now Pat. No. 6,976,540.

(60) Provisional application No. 60/567,236, filed on May 1, 2004.

(51) Int. Cl.
*E21B 19/00* (2006.01)
*E21B 19/06* (2006.01)

(52) U.S. Cl.
USPC ..... 294/91; 294/102.2

(58) Field of Classification Search
USPC ..... 294/102.2, 102.1, 90, 91, 31.1, 86.1, 294/104, 106, 116; 166/380, 77.52; 175/52, 175/85
See application file for complete search history.

(56) References Cited

U.S. PATENT DOCUMENTS 1,558,261 A * 10/1925 Grady ..... 294/91
1,656,582 A * 1/1928 Harder ..... 294/91

(Continued)

FOREIGN PATENT DOCUMENTS

GB 267073 5/1927

OTHER PUBLICATIONS

BJ Hughes, Oilfield Products and Systems, Power Pipe Handling, 10 pages (1984).

(Continued)

*Primary Examiner* — Paul T Chin
(74) *Attorney, Agent, or Firm* — Amerson Law Firm PLLC

(57) ABSTRACT

An apparatus for handling a pipe having a body, the body defining an open throat that is adapted to receive a pipe, a plurality of jaws hingedly mounted to the body that are adapted to engage a pipe while preventing the pipe from engaging the body, each of the jaws defining a concave portion that is adapted to engage the pipe, the apparatus further including respective over-center mechanisms that are arranged between and operatively coupled to the body and each one of the plurality of jaws, each respective over-center mechanism being adapted to inhibit a respective one of the plurality of jaws from closing when jaws are open and to inhibit a respective one of the plurality of jaws from opening and disengaging from a pipe when the jaws are closed on the pipe.

27 Claims, 16 Drawing Sheets

(56) References Cited

U.S. PATENT DOCUMENTS

| | | | | | |
|---|---|---|---|---|---|
| 1,690,709 | A | | 11/1928 | Wilson | |
| 1,754,288 | A | * | 4/1930 | Smith | 294/91 |
| 1,774,675 | A | * | 9/1930 | Smith | 294/91 |
| 1,814,990 | A | | 7/1931 | Weston | |
| 1,901,339 | A | * | 3/1933 | Stevenson | 294/91 |
| 2,009,942 | A | * | 7/1935 | Moody | 294/91 |
| 2,218,000 | A | * | 10/1940 | Grau et al. | 294/91 |
| 6,073,699 | A | | 6/2000 | Hollingsworth, Jr. | 166/379 |
| 6,494,273 | B1 | | 12/2002 | Martin | 175/220 |
| 6,536,520 | B1 | * | 3/2003 | Snider et al. | 166/78.1 |
| 6,568,479 | B2 | | 5/2003 | Mosing et al. | 166/380 |
| 6,626,238 | B2 | | 9/2003 | Hooper | 166/66 |
| 7,032,678 | B2 | * | 4/2006 | Mosing et al. | 166/380 |

OTHER PUBLICATIONS

BJ Hughes, Power Pipe Handling, 11 pages (1980).
Derrick Corporation, Pyramid Screens, 3 Dimensional Screen Technology, 4 pages (1994).
Derrick® Equipment Company, Composite Catalog, A Complete Line of Solids Control Equipment, 28 pages (2006).
Maritime Hydraulics, General Catalogue, 10 pages (2005).
Maritime Hydraulics, Vertical Pipe Handling, 6 pages (1993-1994).
National Oilwell, HydraRacker, 2 pages (2007).
Varco, Automated Pipe Racking Systems, 6 pages (2001).
Varco®, BOP Work Platform, Composite Catalog®, 37$^{th}$ Revision, 2 pages (1986-1987).
Varco®, Compact Racker, 2 pages (2003).
Varco®, Pipe Handling Machine, 2 pages (2002).
Varco Systems, Pipe Racking System PRS-8/8i, 2 pages (2002).

* cited by examiner

APPARATUS AND METHOD FOR FACILITATING HANDLING PIPE

This is a 371 of PCT/GB 2004/003431, filed Aug. 9, 2004, which claimed priority from U.S. provisional patent application Ser. No. 60/567,236, filed May 1, 2004, and is a continuation-in-part of U.S. patent application Ser. No. 10/807,641, filed Mar. 23, 2004, now U.S. Pat. No. 6,997,265, which is a continuation-in-part of U.S. patent application Ser. No. 10/734,923, filed Dec. 12, 2003, now U.S. Pat. No. 6,976,540.

The present invention relates to an apparatus and a method for facilitating handling pipe and particularly, but not exclusively for facilitating handling pipe on and around a drilling rig. The pipe may be a single section or stand of drill pipe, a section or stand of casing, tubulars, premium tubular, drill collars or pipe incorporating a well tool or any pipe having a portion of larger diameter than the main body of the pipe.

In the drilling, completion and workover of a borehole in the oil, gas, water and geothermal industries pipes are run into and out of a borehole. Such an operation is sometimes referred to as "tripping in" for moving pipes down into a borehole and "tripping out" for moving pipes up and out of a borehole. Each of these operations requires pipes to be moved around a drilling rig. Accordingly, there are many problems associated with the handling and logistics of pipe handling of a drilling rig especially in the interconnecting, disconnecting, and storing of pipes on an oil drilling platform without interrupting the drilling process.

The types of pipes which need to be moved around a drilling rig comprise drill pipes, drill collars, casings, tubing, perforated tubing, liners, liner hanger tools, packers, well cleaning tools etc.

Current systems for moving pipes on and around a drilling rig incorporate an elevator arranged on the end of a line hanging over a pulley wheel or travelling block hung from a derrick of the drilling rig. The other end of the line is wound round a winch. The elevator generally comprises a pair of hinged semicircular segments, a latch and a safety mechanism to ensure the latch is closed properly. Such an elevator is sold by BJVarco under the trade name "A-Series Elevators" and "Single Joint Elevator". The pipe lays horizontally on a "catwalk" or on an inclined ramp or conveyor and is lifted manually clear of the surface on which it lays or the end of the pipe is exposed over a ledge. The segments of the elevator are closed about the body of the drill pipe and the latch is closed and the safety mechanism, usually a split pin is pushed into position to ensure the latch is properly closed and will not allow the latch to be opened until the split pin is removed. The elevator loosely fits around the body of the pipe such that the elevator can slide therealong until the elevator abuts an upset in the pipe or a collar threaded to an end of the pipe. Drill pipe comprises an upset known as a "box" in which a female threaded end is located, alternatively an end of the pipe is threaded on to which is threaded a collar of larger outer diameter, which form a shoulder. The winch is activated to lift the elevator and the pipe hanging therefrom clear of the rig floor to facilitate movement of the pipe on and around the drilling rig. A roughneck is then able to swing the pipe to another location, usually for stabbing into a string of pipe already in the well or located in a mousehole. One particular use is to facilitate movement of the drill pipe from the pipe storage areas to the well centre and the storage area close to the well centre known as the "fingerboard". This method is used in tripping-in operations.

Prior art elevators are able to orient the elevator throat opening downward with the doors on many door-type elevators, swinging on hinges. The doors on a large elevator, which must be closed around the pipe, may weigh several hundred pounds. An elevator with doors needs clearance for the doors to swing in an arc under the pipe being engaged. The pipe has to be elevated, or clearance otherwise provided, for swinging doors.

Many prior art elevators are of a "non-slip" variety which have generally been constructed with doors (generally, one or two) which open to allow the insertion or removal of the pipe; doors which traditionally are heavy, slow in operation, difficult to handle and can present a considerable safety hazard to the operator. The balance point of such an elevator can change when the doors are open, thus creating handling problems and adding danger to the operator. Especially with very heavy pipes, for example, large casing, the pipe is initially in a horizontal position, laying in place on or near the floor beneath a derrick, and the hinged door elevator is lowered near the point of attachment to the pipe. The derrick personnel then are required to open the heavy door or doors, which may weigh several hundred pounds, to allow the elevator to be placed over the tubular. Because the door or doors must close around the tubular, the tubular end around which the elevator is located is often above the derrick floor.

During a drilling operation on a conventional oil drilling platform, when the drill bit has penetrated such a distance into a borehole that only a small part of the drill string extends upwards from the upper surface of the drill floor, the drilling operation is stopped, and a new tubular drill string section is moved from a storage site or rack positioned outside the drill floor and connected to the upper end of the drill string. Once the new section is connected, the drilling operation may be continued. Normally, the length of the drill string sections is 30 feet or about 9 m (or a double or triple multiple thereof). This means that each time the drill bit has penetrated further into the underground, the drilling operation has to be stopped and a further drill string section (or stand) is added.

Often there is idle time in which no actual drilling takes place. In view of the fact that the investment made in a drilling rig is very high even a relatively small reduction of the idle time is significant.

One solution commonly used to reduce the idle time on drilling rigs is to assemble two drill string sections, or singles, each having a length of about 10 m into a 20 m stand, or double, placing the singles in a mousehole adjacent to the drilling opening and connecting the singles by using air tuggers and spinning wrenches while the drilling operations proceeds. One exemplary system and apparatus for such offline standbuilding is described in U.S. Pat. No. 4,850,439, the disclosure of which is incorporated herein by reference. However, although these conventional offline standbuilding systems do create significant efficiencies in the drilling process, they generally utilize many complex pieces of equipment, such as, hoists and multi-purpose pipehandling machines that result in a system which is complicated, costly, and requires significant ongoing maintenance.

U.S. Pat. No. 6,073,699 discloses an elevator for lifting wellbore tubulars, the elevator having a pair of hinged doors, the doors interlocking with the use of a locking pin to prevent the elevator from opening.

U.S. Pat. No. 6,494,273 discloses a single joint elevator for lifting drill pipe and casing, the single joint elevator comprising a pair of hinged doors and a latch mechanism for ensuring locking the doors closed.

U.S. Pat. No. 6,568,479 discloses a horseshoe shaped elevator having spring loaded catches to allow the throat of the elevator to be pushed over the body of a drill pipe and to inhibit removal. The elevator is removed from engagement with the drill pipe by urging the pipe towards the throat where it engages an enabling lever which lifts a security lock or to use a dumping lever, which retracts the catches. A separate elevator is thus required for each specific size of pipe.

The BX Hydraulically Actuated Elevator is designed for lifting a complete string of pipe, as well as stands or single sections. The elevator comprises an arcuate body subtending a third of a circle and two arcuate doors, each arcuate door subtending a third of a circle, one end of each arcuate door is hinged to the body and the other end of each door is provided with a female and male parts respectively of a latching mechanism.

The inventors have recognized that there is a need for an elevator which can be placed a pipe lying on the floor; the inventors have recognized that there is a need for an elevator which can be removed from the pipe from one position on the drill floor; the inventors have recognized that there is a need for an elevator which can be removed from one side of the elevator; the inventors have recognized that there is a need for an elevator which can be removed from the pipe in a single pull operation; there is a need for an elevator which has a safety mechanism which provides a positive indication that the elevator is locked, so that the pipe is unlikely to disengage itself from the elevator. The inventors have recognized that there is a need for an elevator which can be adapted easily and quickly for use with a range of diameter and types of drill pipe, casing other tubulars and downhole tools.

According to the present invention, there is provided an apparatus for facilitating handling pipe, the apparatus comprising a body defining an open throat, and at least one jaw having a concave side for engaging a pipe the concave side having two opposed ends characterised in that said at least one jaw further comprises a jaw portion extending behind the concave side, said jaw portion hingedly mounted to said body between the two opposed ends about which said at least one jaw is rotatable with respect to the body to engage a pipe.

Preferably, the concave portions are arcuate, subtending a portion of a circle. Advantageously, the concave side for engaging a pipe comprises a seat portion for receiving an enlarged portion in or connected to said pipe, such as a box, upset or collar. Advantageously, the portion extending behind the concave side extends behind the midpoint between the ends of the concave side. Preferably, the throat is at least as deep as half the diameter of a pipe to be held therein. Advantageously, the at least one jaw conforms to the general shape of the pipe to be held, which is most likely to be circular. The at least one jaw preferably subtends a portion of a general shape of the pipe, preferably part circular, preferably at least twenty degrees, more preferably at least forty-five degrees and most preferably at least one hundred and twenty degrees and advantageously at least one hundred and forty degrees. Advantageously, the jaw portion is between 5 cm and 20 cm long preferably measured as the shortest distance between the pipe engaging surface and the hinge.

Preferably, the body is generally horseshoe shaped and the open throat is defined by the horseshoe shaped housing. Preferably, each jaw of the two jaws has a tapered edge, preferably to correspond to the taper on an upset of pipe. Advantageously, the at least one jaw is arranged at least partly rotatable within the throat. Preferably, the at least one jaw is rotatable about a hinge pin arranged in the body. Advantageously, the hinge pin is removable from the body. This facilitates easy change of the jaws for jaws of a different size to cope with handling different size pipes and upsets or different range of sizes of pipes and upsets. Preferably, the jaws are curved, preferably to match the curvature of a pipe to be engaged. Advantageously, the apparatus further comprises a locking pin and releasably fixing the hinge pin to the body.

Preferably, the apparatus further comprises a further jaw. A pipe to be engaged in the apparatus may be engaged solely by the two jaws.

Advantageously, the at least one jaw is inhibited from rotation by a locking member. The jaws may comprise an extended portion which forms a locking portion which can be used in a locking arrangement. This portion may extend into the throat. The locking member may be arranged between the two jaws to inhibit rotation of both jaws. Preferably, the locking member is movable into and out of engagement, advantageously, manually on a handle which may be external of the housing and may be linked to the spring loaded member by a shaft. Preferably, the locking member is movable by powered means such as a pneumatic, hydraulic or electric actuator and preferably incorporate a control system and is controlled from the operator's cabin. Preferably, the locking member is arranged on at least one resilient means, such as any of the following: pneumatic piston and cylinder, hydraulic piston and cylinder and an accumulator, a coiled spring, Belville washers, and resilient material such as a foam, but most preferably a compression spring.

Preferably, the body further comprises a seat for the at least one jaw to abut when a pipe is engaged.

Preferably, the locking member comprises a safety device for ensuring the locking member locks the at least one jaw when engaged with a pipe. The locking member may be wedge like to wedge the jaws in a closed position. Advantageously, the safety device comprise an indicator on the locking member and an indicator in the body, wherein in use, alignment of the holes indicates that the locking member is in the correct locking position. Preferably, the apparatus also comprises a safety locking pin, wherein the indicator on the locking member is a hole and the indicator on the body is a hole, wherein in use, the holes align and the safety locking pin is inserted therethrough.

Preferably, the apparatus further comprises a resilient means arranged between the body and the at least one jaw wherein the at least one jaw is inhibited from closing by the resilient means when the at least one jaw is in a substantially fully open position. This helps maintain the jaws in a fully open position, so that the at least one jaw does not close when the throat of the apparatus is applied to pipe lying on the floor, such as on a catwalk or a ramp. Advantageously, the apparatus further comprises a resilient means arranged between the body and the at least one jaw wherein the at least one jaw is inhibited from opening by the resilient means when the at least one jaw is in a substantially fully closed position. This maintains the at least one jaw in the correct position for applying a safety device, such as inserting a safety locking pin. The resilient means may be any or any combination of the following: pneumatic piston and cylinder, hydraulic piston and cylinder and an accumulator, a coiled spring, Belville washers, compression spring and resilient material such as a foam. Preferably, the apparatus further comprises a resilient means arranged between the body and the at least one jaw wherein the at least one jaw is inhibited from closing when the at least one jaw is in a substantially fully opened position and inhibited from opening by the resilient means when the at least one jaw is in a substantially fully closed position, wherein the resilient means is arranged in an over-centre mechanism. The action of the jaws may be cam like. Advantageously, the over-centre mechanism comprises a spring guide and a pin and the resilient means comprises a spring, the spring guide rotatable about the pin, the spring compressible in the spring guide upon movement of the at least one jaw.

Preferably, the apparatus further comprises at least one handle for carrying and applying the apparatus to a pipe.

The invention also provides an elevator comprising the apparatus of the present invention.

There have long been needs, recognized by the present inventors, for efficient and effective elevators and for a simpler, less costly system for providing offline standbuilding and pipehandling functionality to standard oil platforms.

The invention also provides a method for facilitating handling pipe, the apparatus of the invention, the method comprising the steps of lowering the throat of the apparatus over a pipe, the at least one jaw rotating to engage the pipe.

The invention also provides a drilling rig comprising a platform having a wellcentre and at least one preparation opening characterised in that the platform further comprises a rotatable tower on which pipe can be rotated about.

Preferably, the tower further comprises a carriage arranged on the tower to move therealong. The carriage may further comprise wheels, bearings or other means to facilitate movement up and down the tower.

Advantageously, the carriage comprises an arm. Preferably, the arm is of fixed length or extendible, for example, telescopic. Advantageously, the carriage comprises two arms, which may be of the same fixed length or may be of different lengths, one or both of which may be extendible. If they are of fixed but different lengths, it is advantageous for the preparation openings (mouseholes) to be at corresponding distances from the tower.

Preferably, the at least one preparation hole is spaced from the tower an equal distance to the length of the arm. Most preferably, the drilling rig has two preparation openings, both equal distances from the tower.

Advantageously, the drilling rig further comprises a wireline for hoisting a pipe. Preferably, the wireline is arranged along or within the tower and preferably over a pulley wheel in the top portion or at or above the top of the tower and advantageously, the wireline runs externally of the tower to hoist a pipe. Preferably, the wireline also hoists the carriage. Advantageously, the drilling rig further comprises a winch for winding the wireline. The winch may be electrically, pneumatically, hydraulically powered or use stored energy, such as the stored energy in a wound spring or flywheel. Preferably, an elevator is arranged on the end of the wireline. Advantageously, the elevator is of the type of the present invention.

The present invention also provides a method for handling pipe, the method comprising the steps of picking up pipe on the end of a wireline and rotating the pipe on a rotatable tower to align with a preparation opening.

Preferably, the method further comprises the steps of lowering the pipe into the preparation opening, preferably using a wireline on a winch. Advantageously, a second pipe is lowered into a second preparation opening and most preferably, a third pipe is brought into alignment with the second pipe and is connected thereto to form a double, preferably using a spinner to spin the threads up to a low torque and most preferably using a torquing unit to torque the connections to the predetermined in use design torque. Advantageously, the double is connected to the first pipe to form a triple. Most advantageously, the triple is gripped by at least one manipulating arm and preferably moved to a storage rack, preferably a fingerboard or directly to the wellcentre.

For a better understanding of the present invention, reference will now be made, by way of example, to the accompanying drawings, in which.

Figure 1:
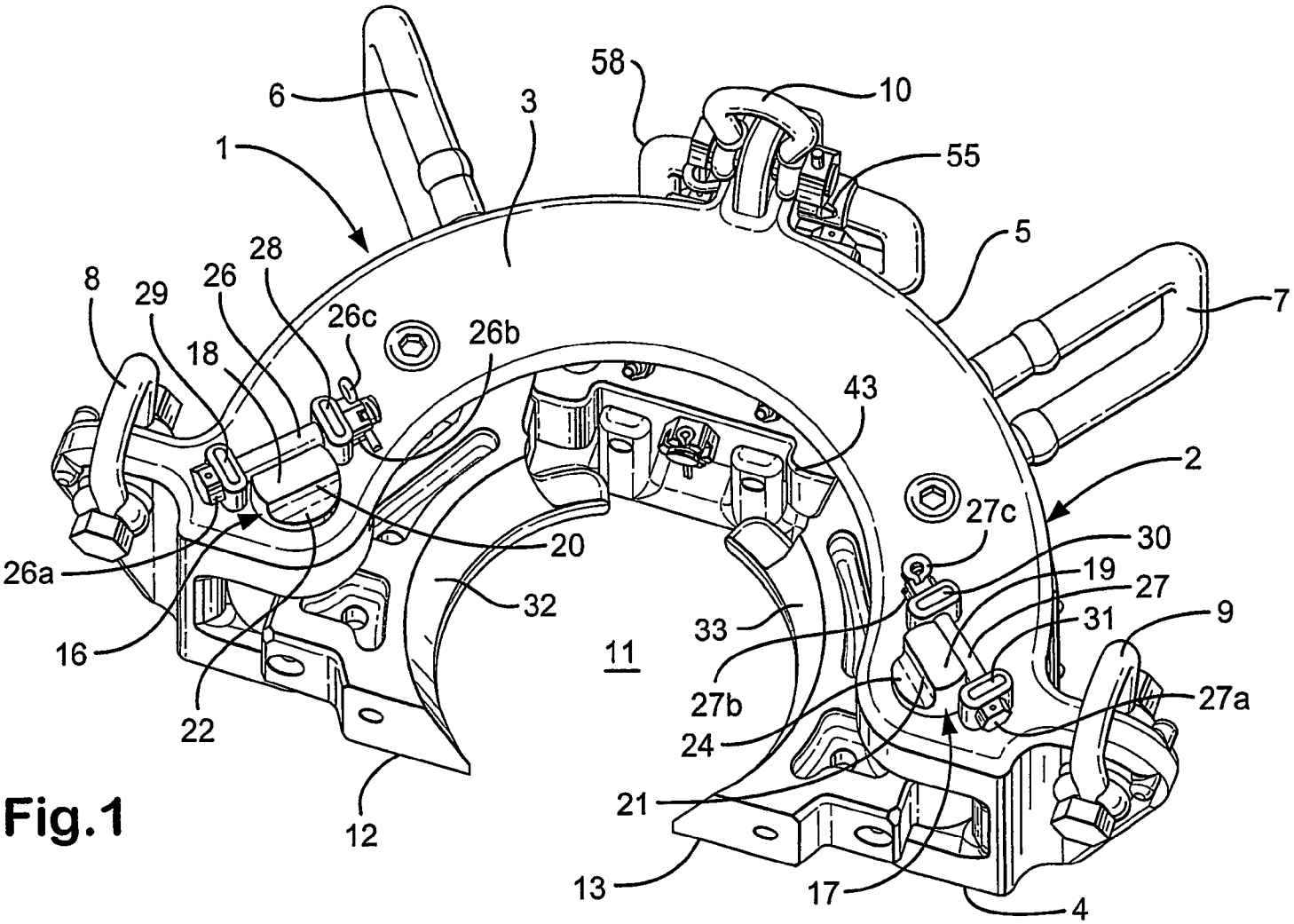
FIG. 1 is a perspective view of an apparatus of the present invention, the apparatus comprising a pair of jaws shown in a closed position.
Figure 2:
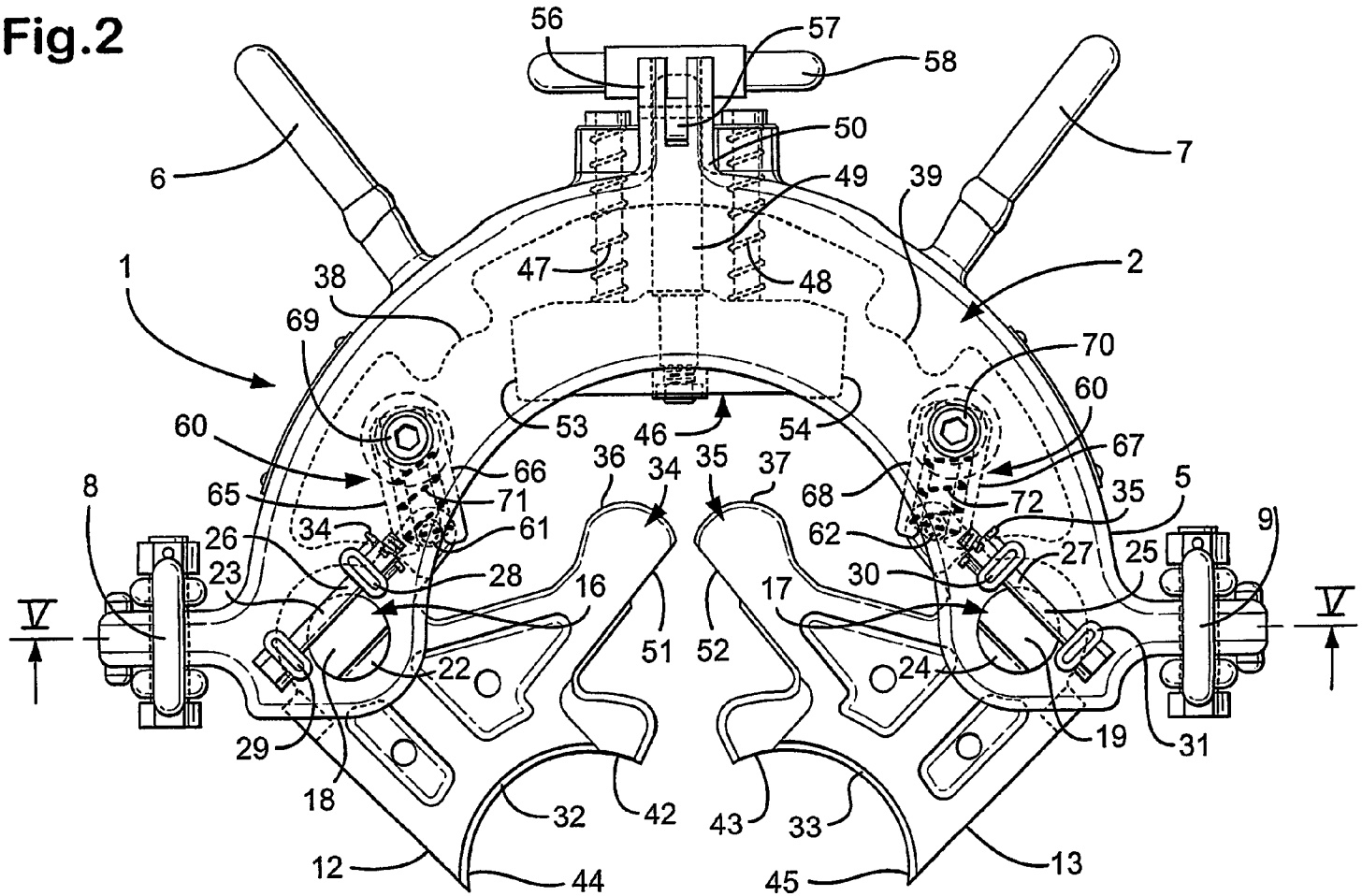
FIG. 2 is a top plan view of the apparatus of FIG. 1, with hidden parts shown in dashed lines, wherein the pair of jaws is in an open position.

FIGS. 1 to 7 show an apparatus in accordance with the present invention generally identified by the reference numeral 1. The apparatus 1 forms part of a pipe lifting system shown in FIG. 8. The apparatus 1 is generally referred to herein as an elevator. The elevator 1 has a horseshoe shaped (U-shaped) housing 2. The horseshoe shaped housing 2 may be cast or machined having a horseshoe shaped top plate 3, a horseshoe shaped bottom plate 4 and a curved outer wall 5 to which are secured two handles 6 and 7. Alternatively, the horseshoe shaped top plate 3, the horseshoe shaped bottom plate 4 and the curved outer wall 5 could be separate pieces welded, bolted or otherwise attached together. Two shackles 8 and 9 are arranged in eyes on opposing sides of the housing 2 for connection to wire lines (shown in FIG. 8 et seq) of a hoist system and a shackle 10 is provided on the back of the housing 2 for connection to a balancing line (shown in FIG. 8 et seq), to ensure the elevator 1 and a pipe (not shown in FIG. 1) held in the elevator 1 stays in the correct orientation, usually so that the pipe hangs substantially vertically when depending from the wire lines, as described herein with reference to FIG. 8 et seq.

Figure 6:
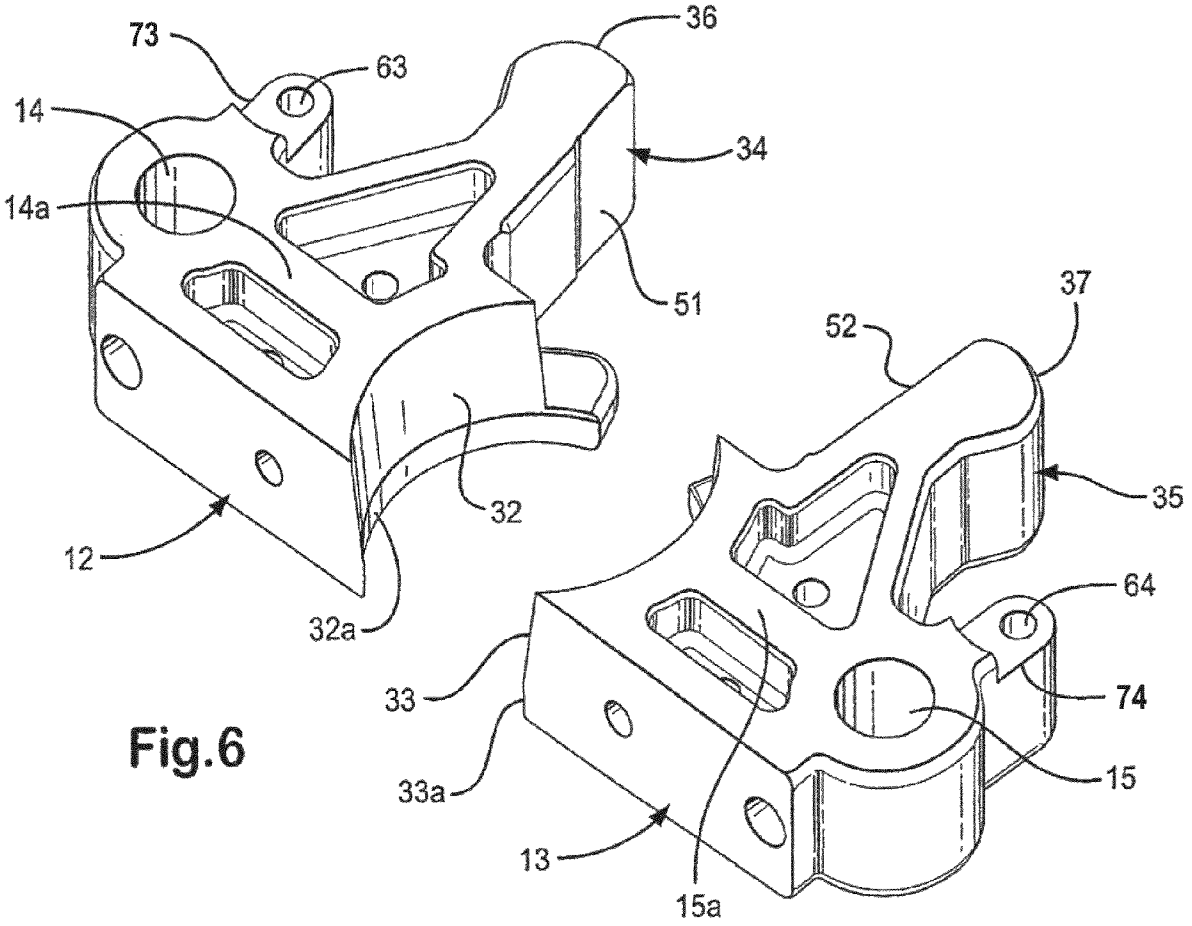
FIG. 6 is a perspective view of a pair of jaws of the apparatus shown in FIG. 1.

The body 2 has an open throat 11. Dual opposed jaws 12 and 13 are arranged between the top plate 3 and bottom plate 4 between the two shackles 8 and 9 and the dual opposed jaws 12 and 13 are hingedly movable within the throat 11. The jaws 12 and 13, a set of which are shown in FIG. 6, are cast or machined from a steel or steel alloy or other suitable material, each with a hole 14 and 15 therein for receiving a removable hinge pin 16 and 17. Each hinge pin 16 and 17 passes through holes in opposing sides of the top plate 3, which preferably have a friction fit, but may be threaded or have a loose fit and through the holes 14 and 15 in the jaws 12 and 13 and into holes (not shown) in the bottom plate 4, which friction fit, but may be threaded or have a loose fit. The jaws 12 and 13 are hingedly movable in relation to the body 2 about the hinge pins 16 and 17. The hinge pins 16 and 17 comprise a smooth cylindrical shaft of circular cross-section, but may have threaded portions for a threaded connection to the top plate 3 and/or bottom plate 4. The hinge pins 16 and 17 also comprise a head 18 and 19, which is of larger diameter than the shaft of the respective pin 16 and 17. Each head 18 and 19 has an upwardly extending portion 20 and 21 having two ledge portions 22,23 and 24,25, although one ledge portion would be sufficient for a safety locking mechanism. The safety locking mechanism comprises a removable bar 26 and 27 is removably arranged in eyes 28,29 and 30,31 fixed to the top plate 3, such that once the hinge pins 16 and 17 have been inserted, and optionally screw threaded into place, each head 18 and 19 is twisted to the correct orientation in which the bar 26 and 27 is inserted through the eyes 28,29 and 30,31 over the ledge portions 23 and 25 to inhibit the hinge pins 16 and 17 from falling out or vibrating lose. The removable bars 26 and 27 may be provided with one enlarged end 26*a* and 27*a* and a castellated nut 26*b* and 27*b* on a thread on the opposing end and a hole for receiving a split pin 26*c* and 27*c* to inhibit rotation of the castellated nut 26*b* 27*b* in order to inhibit the removable bars 26 and 27 from falling out of the eyes 28,29 and 30,31.

Figure 3:
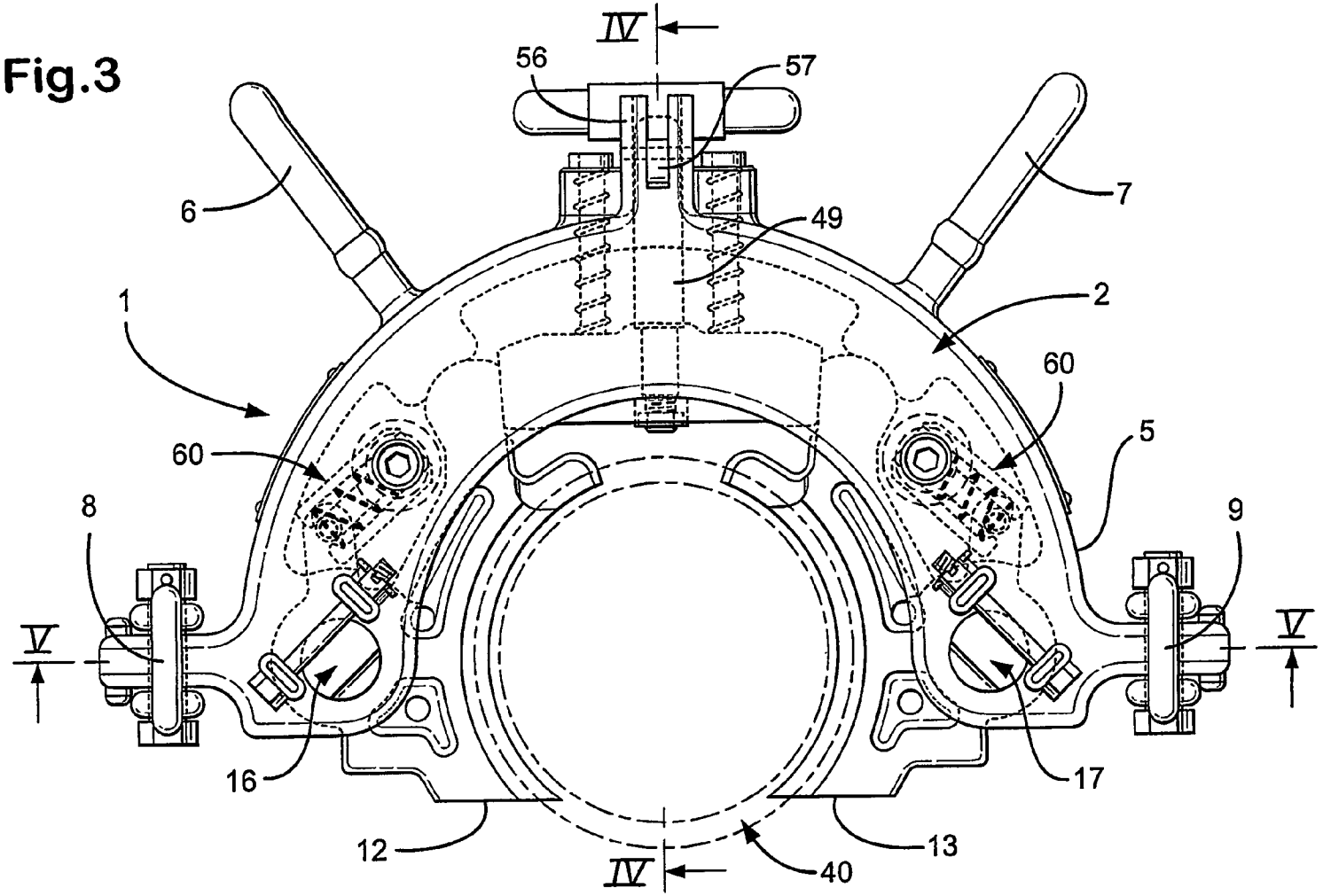
FIG. 3 is a top plan view of the apparatus of FIG. 1, with hidden parts shown in dashed lines, wherein the pair of jaws in a closed position around a drill pipe.
Figure 4:
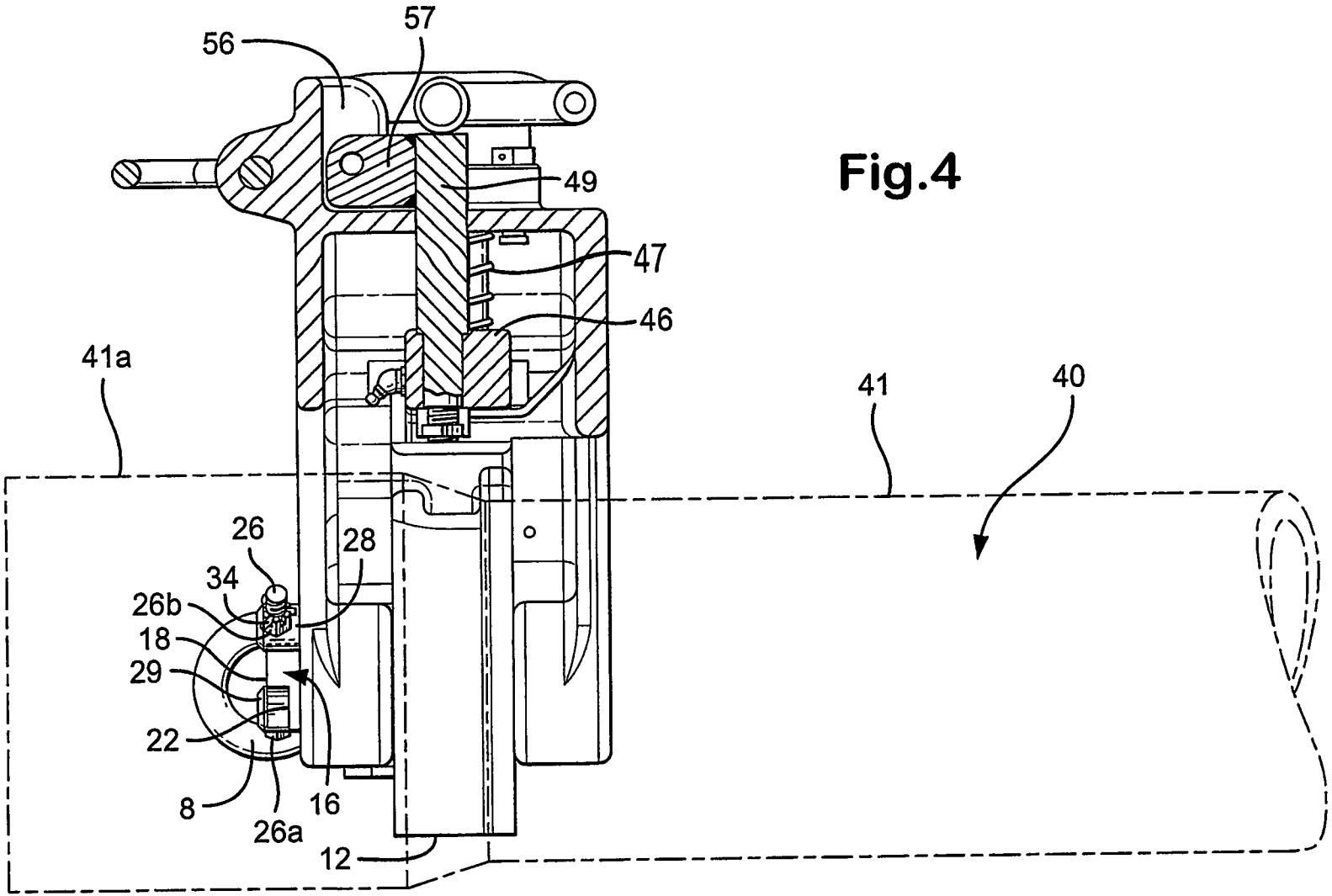
FIG. 4 is a cross-sectional view taken along line IV-IV of FIG. 3, with selected parts deleted for clarity and selected hidden parts shown in dashed lines.
Figure 5:
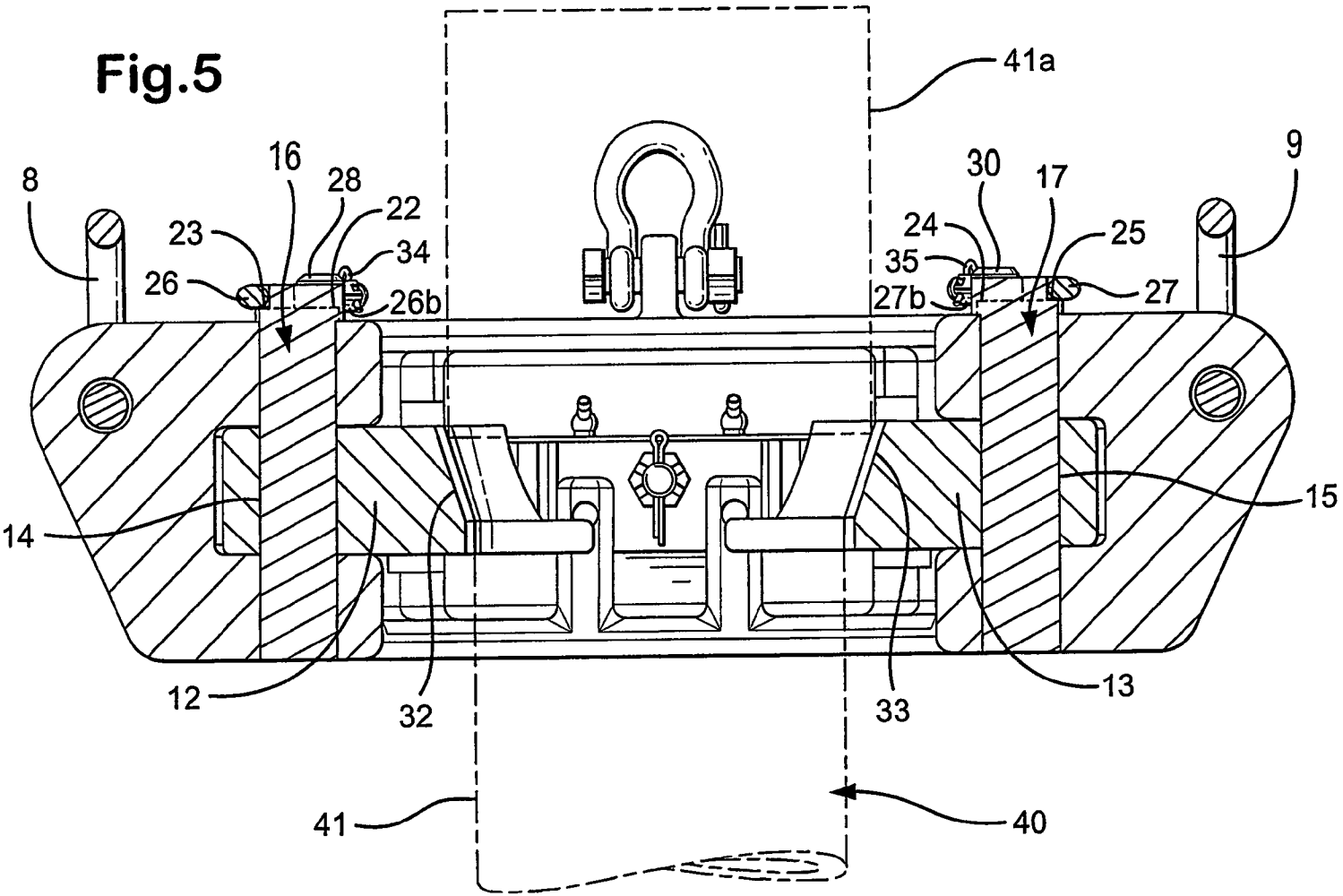
FIG. 5 is a cross-sectional view taken along line V-V of FIG. 3, with hidden parts shown in dashed lines.

The jaws 12 and 13 are thus easily replaceable by removing the hinge pins 16 and 17, removing the jaws 12 and 13 and inserting a new set of jaws and replacing the hinge pins 16 and 17. This is advantageous, as a different set of jaws is required to match a particular size or range of sizes of pipe diameters and upset sizes. The jaws 12 and 13 further comprise an angled seat portion 32 and 33. The seat portions 32 and 33 are arcuate and subtend an angle of approximately 140°. The hinge pins 16 and 17 are located at a mid point, approximately 70° from either end of the arcuate seat portions 32 and 33 and located behind the seat portions 32 and 33 by a jaw portion 14*a* and 15*a* by between 5 and 20 cm depending on which jaws 12 and 13 are used, which depends on the size of pipe and upset to be handled. The seat portion 32 and 33 is sized such that when the jaws 12 and 13 are in the closed position engaged over a pipe, the elevator 1 can slide along the body of the pipe until the angled seat portions 32 and 33 engage with an upset on the pipe, such that the upset seats itself in the seat portion 32 and 33. Typically, the angle of the seat portion is between 5° and 45° and most typically between 5° and 9° from the vertical. The angled seat portion 32 and 33 may have a lower portion 32*a* and 33*a* which is substantially vertical. The jaws 12 and 13 also comprise a locking portion 34 and 35 integral with the jaw 12 and 13 which locking portions 34 and 35 extend back from the seat portion 32 and 33 into the throat 11 of the elevator 1. Each locking portion 34 and 35 has a curved end 36 and 37 which abuts an end stop 38 and 39 when the jaws 12 and 13 are swung into an engaged position about the hinge pins 16 and 17. FIGS. 3, 4 and 5 show the jaws 12 and 13 in a closed position about a pipe 40.

Figure 7:
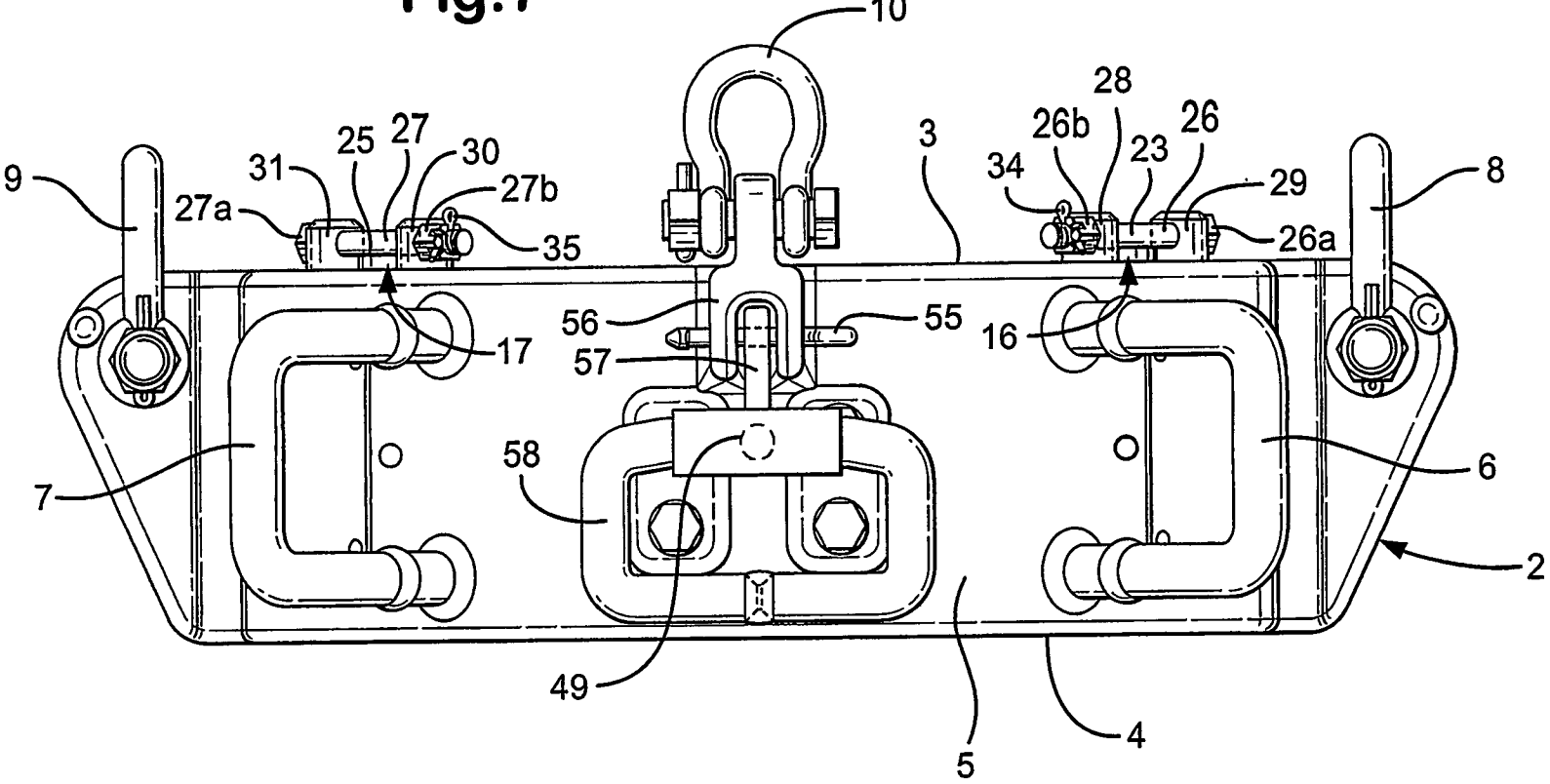
FIG. 7 is a rear plan view of the apparatus of FIG. 1.
Figure 8:
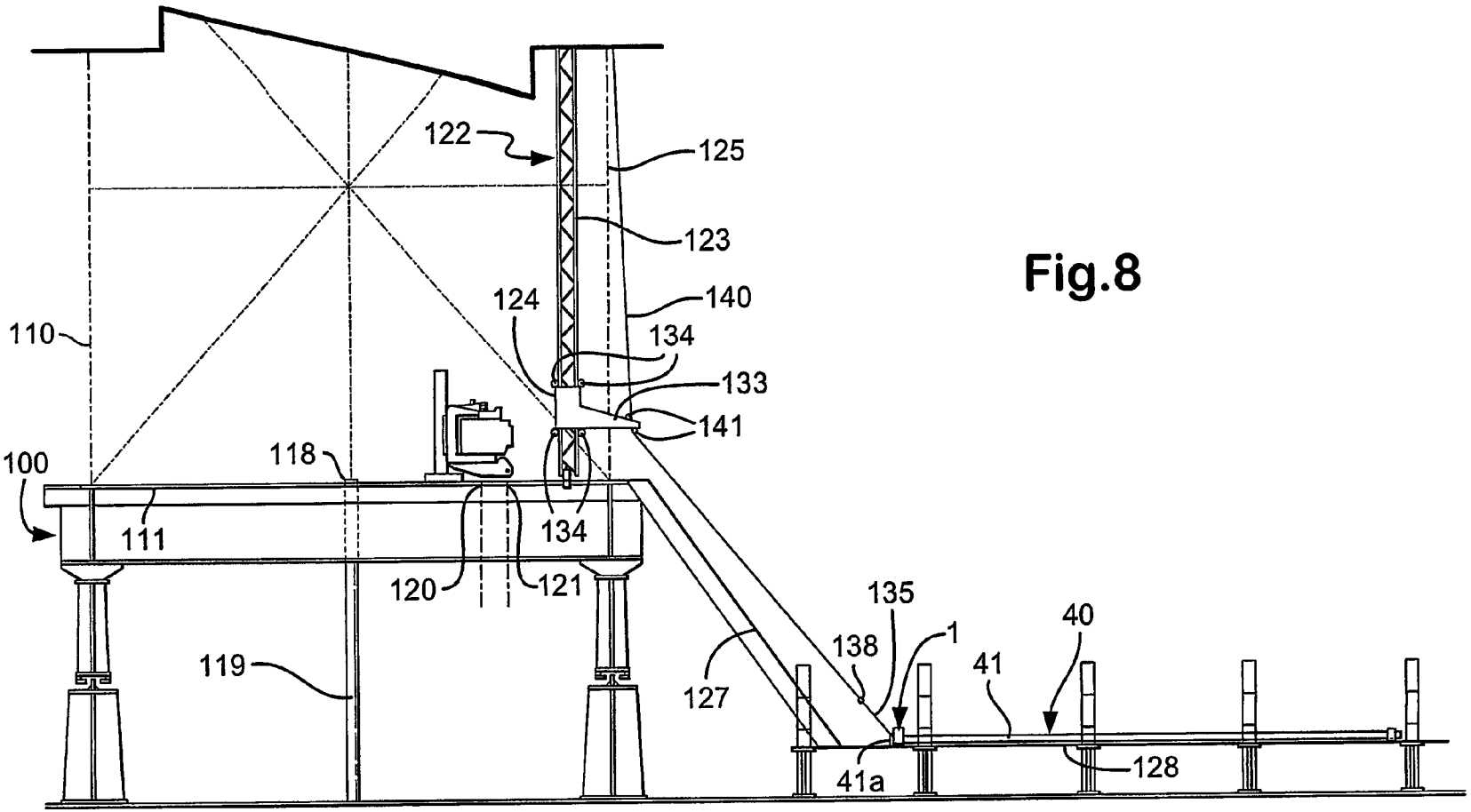
FIG. 8 is a schematic diagram of a side view of parts of a drilling rig of the invention incorporating an apparatus of the present invention, showing a first step in a method in accordance with the present invention.
Figure 9:
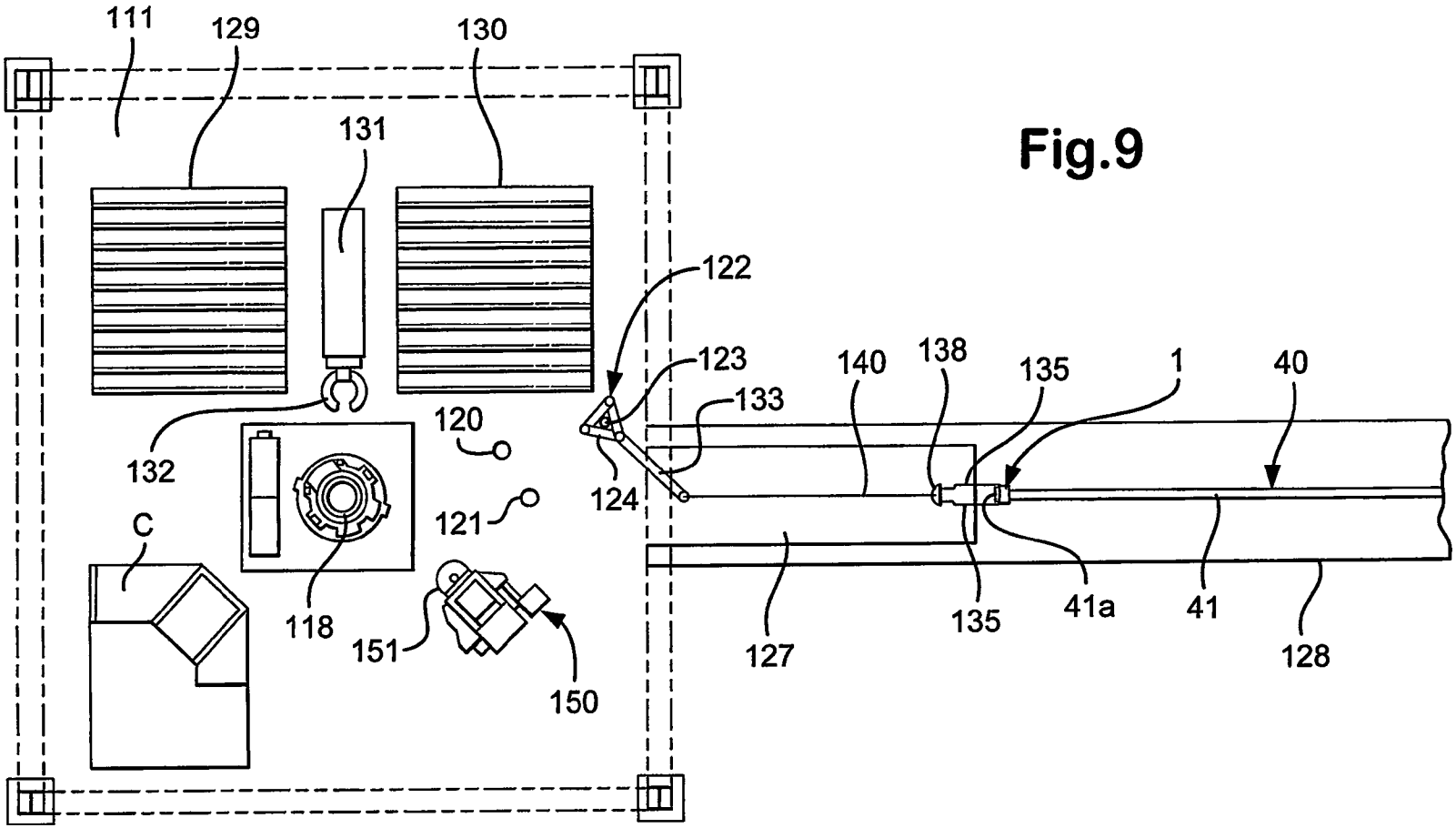
FIG. 9 is a schematic top view of the drilling rig shown in FIG. 8, with further parts shown and other parts not shown.

In use, the elevator 1 is lifted by two roughnecks using the handles 6 and 7. The jaws 12 and 13 hang from the body 2 of the elevator 1 in the position shown in FIG. 2. The elevator 1 is lowered over the body 41 of a pipe 40 lying substantially horizontally or on a slope, The inner portions 42, 43 of the jaws 12 and 13 touch the body 41 of the pipe 40 and under the weight of the elevator 1 the jaws 12 and 13 rotate about the hinge pins 16 and 17 by about forty-five degrees, which locates outer portion 44 and 45 of jaws 12 and 13 over the body 41 of the pipe 40. The curved ends 36 and 37 of the locking portions 34 and 35 of the jaws 12 and 13 abut a spring loaded locking member 46 causing springs 47 and 48 to compress and push shaft 49 fixed to the spring loaded locking member 46 through an opening 50 in the outer wall 5. Movement of the spring loaded member 46 allows the curved portions 36 and 37 of the locking portion 34 and 35 to pass over the spring loaded member 46 and abut the end stops 38 and 39. The compressed springs 47 and 48 now push the spring loaded member 43 back to its original position. Upon lifting the elevator 1, surfaces 51 and 52 of the locking portions 34 and 35 bear against sides 53 and 54 of the spring loaded member 46 preventing the jaws 12 and 13 from rotating about the hinge pins 16 and 17 and hence prevent the jaws 12 and 13 from opening. Referring to FIG. 7, before lifting commences, as a safety precaution, a safety locking pin 55 is inserted in a hole in a lug 56 arranged on the body 2 of the elevator 1 and through a corresponding hole in a lug 57 arranged on the shaft 49, ensuring the shaft 49 and the spring loaded member 46 fixed thereto do not move, which movement may otherwise allow the jaws 12 and 13 to open. The safety locking pin 55 can only be inserted when the holes in the lugs 56 and 57 align. The alignment indicates that the spring loaded member 46 is in the correct position to lock the jaws 12 and 13 in the closed position. The elevator 1 is now lifted on lines (shown in FIG. 8 et seq) connected to the shackles 8, 9, 10. As the elevator 1 is lifted, the elevator 1 slides along the pipe 40 until the upset 41*a* of the pipe seats itself on the angled portion 32 and 33 of the jaws 12 and 13.

To release the pipe 40 from the elevator 1, the pipe is receive in a mousehole, the box of a further section of pipe or in the wellcentre itself. It is preferable to transfer the weight of the pipe 40 away from the elevator before releasing the pipe 40 from the elevator 1. To open the jaws 12 and 13 of the elevator 1, the safety locking pin 55 is removed from the aligned holes in the lugs 56 and 57 and the shaft 49, allowing the spring loaded locking member 46 to be pulled back on shaft 49 using handle 58 which is attached to the end of the shaft 49 external of the housing 2. This frees the locking portions 34 and 35 and allows the jaws 12 and 13 to rotate about the hinge pins 16 and 17, opening the jaws 12 and 13 freeing the pipe 40 from the elevator 1. The elevator 1 can simply be pulled away from the pipe 40 by roughnecks using the handles 6 and 7.

A mechanism 60 is also provided to facilitate the closing and opening action of the jaws 12 and 13 and to help maintain the jaws 12 and 13 open, when the jaws are in the open position and closed when the jaws 12 and 13 are in the closed position. The mechanism 60 comprises a pin 61 and 62 arranged in a hole 63 and 64 in the jaws 12 and 13. The pin 61 and 62 projects on integral lugs 73 and 74 which, as shown in FIG. 6, are recessed from the plane of the top of the jaws 12 and 13, such that the top of the pins 61 and 62 lie in substantially the same plane as the plane of the top of the jaws 12 and 13. The projecting portion of the pin 61 and 62 is arranged between two fingers 65,66 and 67, 68, which are rotatably arranged about a shaft 69 and 70 attached to the body 2, such that on movement of the jaw 12 and 13 about the shaft 69 and 70, the projecting portion of the pin 61 and 62 moves along a path defined between the two fingers 65,66 and 67, 68. A spring 71 and 72 is arranged between the finger 65,66 and 67, 68 to act against the projecting portion of the pin 61 and 62. In use, when the jaws 12 and 13 are open, the spring force acting on the projecting portion of the pin 61 and 62 helps maintain the jaws 12 and 13 in an open position, advantageously with enough spring force to maintain the jaws 12 and 13 open when the throat 11 of the elevator 1 is arranged above and over a pipe lying horizontally. Further, upon closing the jaws 12 and 13, the projecting portion of the pins 61 and 62 moves along the path defined by the two fingers 65,66 and 66,67 which compresses the springs 71 and 72 until the projecting portion of the pins 61 and 62 moves over-centre, at which point the springs 71 and 72 facilitate closing of the jaws 12 and 13 and facilitate the locking portions 34 and 35 of the jaws 13 and 13 acting against the spring loaded member 46. Upon opening of the jaws 12 and 13, the spring 71 and 72 is compressed until the projecting portion of the pin 61 and 62 moves over-centre, at which point the springs 71 and 72 help the jaws 12 and 13 move to and maintain an open position.

Alternatively, the mechanism 60 may be replaced with a mechanism which comprises two jaw positioners, similar to shaft 69 and 70, which are each pivotably mounted to a jaw 12 or 13 with pins and each positioner has a roller rotatably mounted to its other end for rolling along roller surfaces of the housing and on roller surfaces of a the back of the jaws 12 and 13. Springs, similar to springs 71 and 72, urge the rollers against the roller surfaces. The rollers come to rest in the positioner recesses of the jaws 12 and 13 so that, in a jaw-gripping position, the latch ends 34 and 35 of the jaws 12 and 13 are releasably held between the jaw positioners and the latch members.

FIGS. 8 to 14 show schematically a drilling rig generally identified by reference numeral 100. The drilling rig 100 comprises a derrick 110 extending upwards from a drill floor or platform area 111. A drilling hoist comprising a travelling block and a swivel and hook assembly is mounted at the upper part of the derrick, but is not shown in the drawings for clarity. A top drive unit, is mounted on a carriage so as to be displaced along a vertically extending track, is suspended by the hoist in a manner known per se, which are not shown in the drawings for clarity. The drilling hoist and the top drive unit suspended thereby are substantially aligned with a drilling opening 118, known as the wellcentre, defined in the drill floor 111, and the top drive unit may be brought into rotary driving engagement with the upper end of a drill string 119 extending through the drilling opening 118.

Two assembling or preparation openings 120 and 121, known as mouseholes, are defined in the drill floor 111 located in close proximity to the drilling opening 118. A pipe handling apparatus for loading drill pipe and preparing stands of drill pipe is generally identified by reference numeral 122. The pipe handling apparatus 122 comprises a vertically extending frame tower 123 and a slideable carriage 124, which may be referred to as a dolly, to which is arranged an elevator 1, such as the elevator 1 described above. The pipe handling apparatus is provided in close proximity to the mouseholes 120 and 121 and an opening in the side of the derrick 110 known as a V-door 125 facilitates access to areas off the drill floor 111, including access to an access ramp 127, known as a slide, and an area for storing pipes and an access way for use in transferring the pipes from the storage areas to the platform 111, known as a catwalk 128.

The drill floor 111 may further comprise storage areas 129 and 130 arranged in setback areas within the confines of the derrick for storing drill string or well casing stands or bottom hole assembly parts in a vertical position, such storage areas in this preferred embodiment are conventional fingerboards. A pipe handling arm 131 for loading and unloading stands of pipe from the storage areas 129 and 130 comprising a rotatable and extendable gripping device 132 is mounted generally in the setback area preferably between the two storage areas and advantageously in the upper portion of the derrick and within the structure of the derrick 110 to provide for moving stands of pipe or sections of pipe between the wellcentre, stand building mouseholes 120 and 121 and/or storage area 129 and 130. The pipe handling arm 131 is a robotic arm which can manipulate pipe at least two planes: vertical and horizontal, preferably a third plane and has a knuckle joint at a point close to the gripping device 132 for facilitating maintenance of the pipe in a vertical position, and but may be used to angle the pipe. The knuckle joint is able to orient the pipe in roll and pitch and preferably heave. Thus preferably, the arm can manipulate a pipe in all six degrees of freedom.

The drill floor further carries drawworks associated with the drilling hoist. A drillers' cabin C is provided for the operator or driller to operate the pipe handling apparatus from.

The pipe handling apparatus 122 comprises a tower 123, which is slightly taller than three sections of drill pipe. A section of drill pipe is generally about 9.1 m (30 feet) long and so the tower 123 would be at least 30 meters tall for handling stands of three sections of pipe, in another embodiment at least 20 meters tall for handling stands of two sections of drill pipe and at least 10 meters tall for handling one section of pipe. Sections of casing are generally not built into stands before being connected to the string of casing at the well centre 118. However, sections of casing can be of various lengths and the tower may be built of any suitable height if such use is envisaged. Other tools may be handled using the pipe handling apparatus 122 including handling liner hanging tools and liner hanging tool strings and cleaning tools. Liner hanging tools comprise a long string of tools and may be constructed using the pipe handling apparatus of the present invention and thus may require a taller tower of perhaps 40 or 50 meters in height. Bottom hole assemblies can also be put together in a similar way as that described herein, but the number of parts in a 27 m (90 feet) assembly may be different. For example, the process of making bottomhole assemblies (BHA) will typically start with the drill bit, which is brought in and placed in a so-called bit breaker on top of the preparation opening followed by a tubular, so-called BHA part, which is brought in and suspended from the load an preparation pipehandling device, so that the lower end is contacting the drill bit (not shown). The two parts are connected by the spinning and torquing device 150 and then lifted out of the bit breaker. The bit breaker is removed and the interconnected two parts are lowered into the preparation opening and set in slips. From this point on, the stand is completed in the same way as other stands of drill collar sections, drill tube sections, stabilizers, centralizers, scratchers, drill bits, and other drill string or drill casing components as well as production tubing bodies may be assembled into tubular lengths, such as drill string and well casing stands (usually doubles or triples) and logging assemblies. The stands prepared may be transported to one of the storage areas 129, 130 for later use.

The pipe handling apparatus 122 also comprises a carriage 124 having an arm 133 mounted thereon. The carriage is arranged on wheels 134 which facilitate movement of the carriage up and down the tower 123. The carriage 124 does not rotate with respect to the tower 123. The tower is of triangular cross-section, but may be of any cross-section, such as square, circular, rectangular, pentagonal and oblong.

The tower 123 is arranged to be out of alignment with a direct path from the ramp 127 to the wellcentre 118. Preferably, tower 123 is arranged to be out of alignment with a direct path from the V-door 125 to the wellcentre 118. The tower 123 is mounted in lower 136 and upper 137 rotary platforms, so that the tower 123 can rotate about its longitudinal axis. The rotary platforms are driven by a hydraulic, pneumatic or electric motor and controlled from the operator or driller's cabin C. The rotary tables are arranged on bearings (not shown), and the tower could be rotated manually.

A wire 135 having eyes spliced into the wire at each end are connected at one end to the shackle 8 of the elevator 1 and another wire 135 of substantially the same type is attached to shackle 9 of the elevator 1. The other ends of the wires 135 are attached to a yoke 138. A further wire may be attached to shackle 10 to control the orientation of the elevator 1 or to help take the weight of the elevator and the pipe therein and may be attached to the yoke 138. The yoke 138 is attached to the end of a wireline 140 which passes between pulley wheels 141 arranged at a distal end of the arm 133 and over a pulley 139 at the top of the tower 123 and down through the frame structure of the tower to a winch (not shown). The winch (not shown) may be located at the foot of the tower 123 or may be located at the top of the tower 123. The winch may be driven hydraulically, pneumatically or electrically and may be controlled by the operator from the driller's cabin C.

The arm 133 is of fixed length, such that upon rotation of the tower 123, the end of the arm will define a circle or part circle about the tower 123. However, the inventors envisage the arm may be telescopic and moveable towards and away from the tower 123.

In use, a section of drill pipe 40 is moved from a large storage area external the drilling platform and on to the catwalk 128 to lie substantially horizontally with the box end 41*a* having a female thread therein of the drill pipe 40 closest to the V-door 125 and the pin end furthest away from the V-door 125. The elevator 1 is lifted by handles 6 and 7 on the back side of the elevator away from the throat 11. The jaws 12 and 13 of the elevator 1 are placed over the body 41 of the section of drill pipe 40, which lies substantially horizontally on the catwalk 128. Once the body 41 of the pipe 40 is in the mouth 11 of the elevator 1 and the locking portions 34 and 35 of the jaws 12 and 13 are seated in end stops 38 and 39 and the spring loaded member 46 has returned to its normal extended position, the roughneck inserts the safety split pin 55 into the aligned holes in the lugs 56 and 57 to ensure the jaws 12 and 13 are correctly set about the drill pipe 40 and to prevent accidental opening of the jaws 12 and 13.

Figure 10:
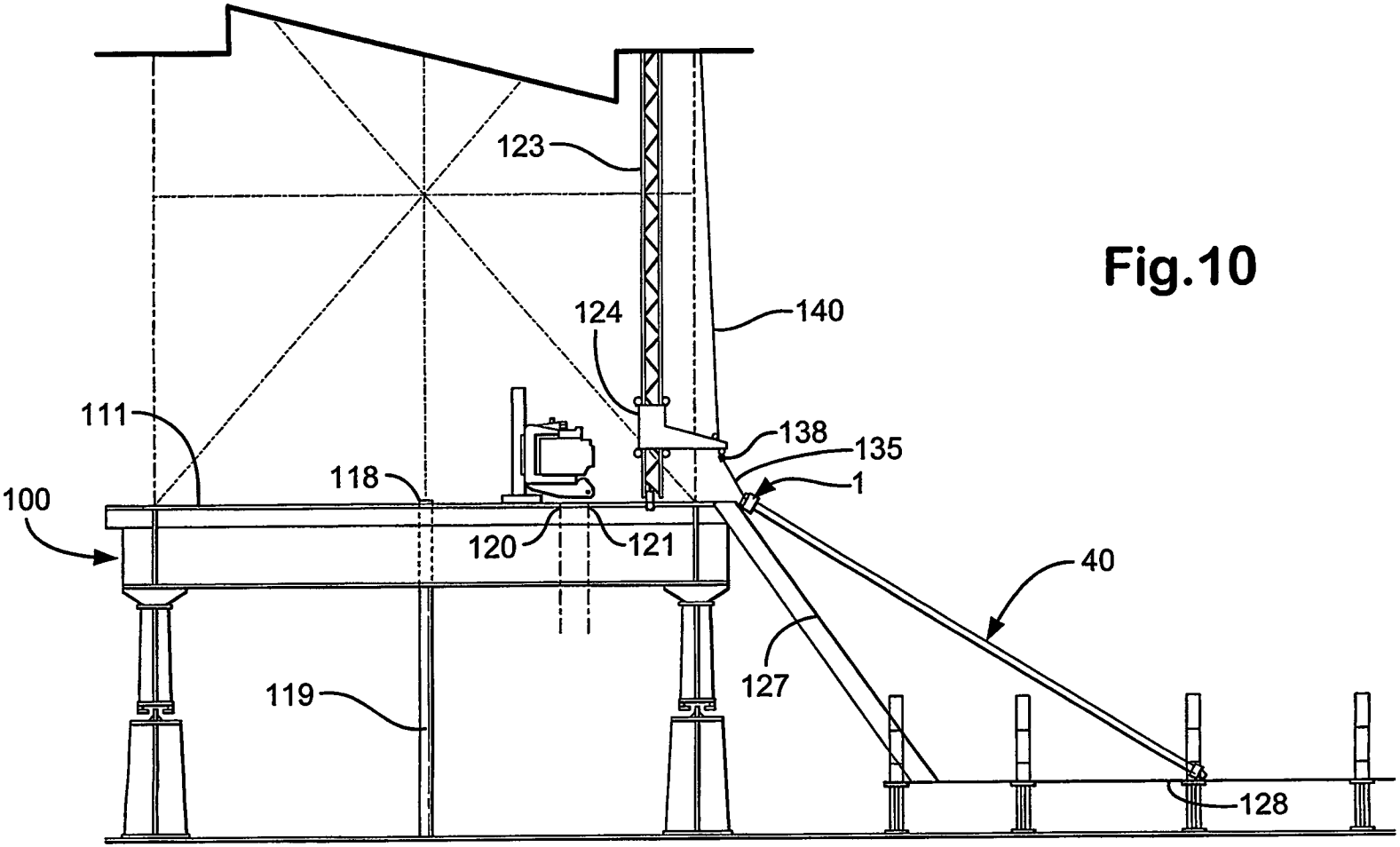
FIG. 10 is a schematic diagram of a side view of part of the drilling rig shown in FIG. 8, showing a second step in a method in accordance with the present invention.
Figure 11:
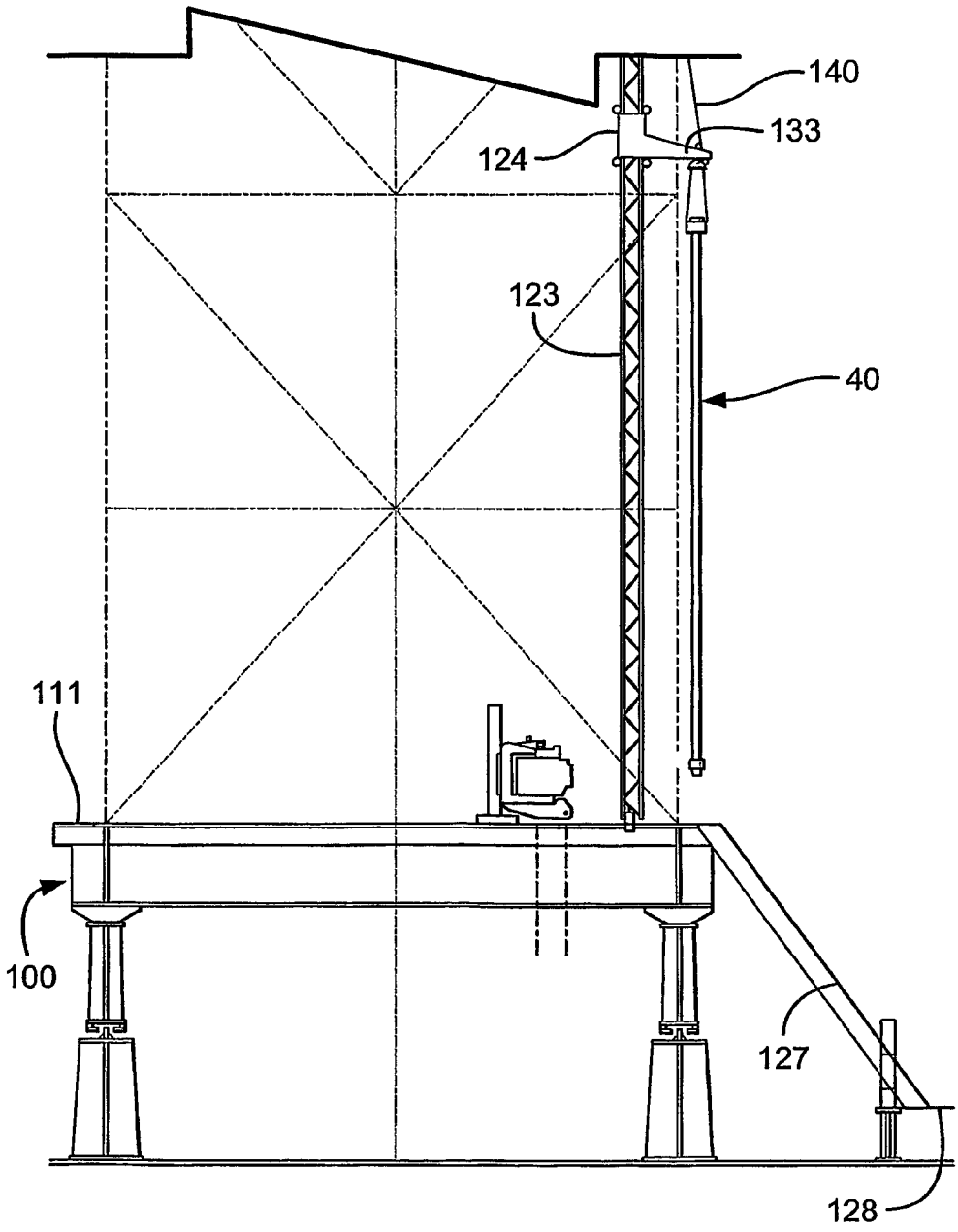
FIG. 11 is a schematic diagram of a side view of part of the drilling rig shown in FIG. 8, showing a third step in a method in accordance with the present invention.
Figure 12:
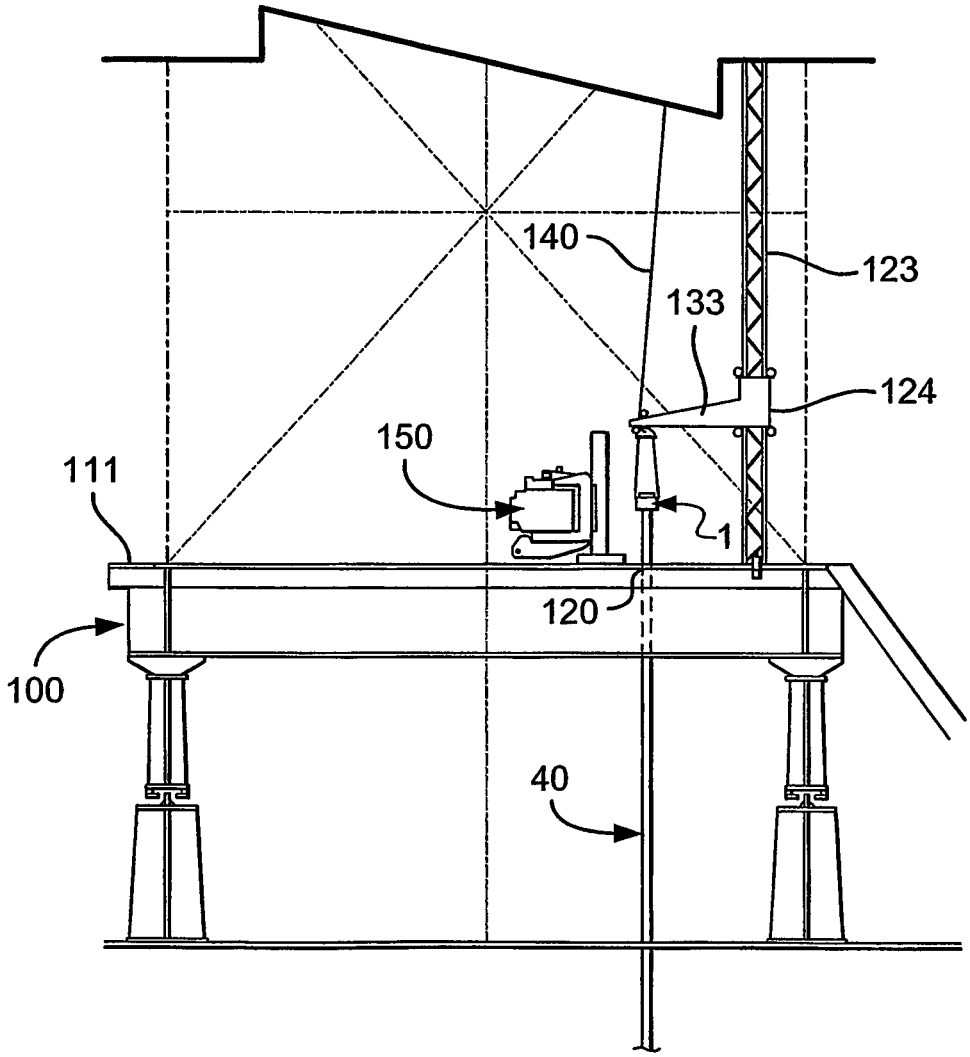
FIG. 12 is a schematic diagram of a side view of part of the drilling rig shown in FIG. 8, showing a fourth step in a method in accordance with the present invention.

The winch (not shown) is operated to wind the wireline 140 in, pulling the elevator 1 along the body 41 of the drill pipe 40 so that the box 41*a* of the drill pipe 40 engages the seat 32 and 33 of the jaws 12 and 13. The winch continues to wind to pull the elevator 1 and the drill pipe 40 engaged in the elevator 1 up the ramp 128, as shown in FIG. 10. The yoke 138 engages with the arm 133 near the guide rollers 141, pulling the arm 133 and the carriage 124 up the tower 123. Once the section of drill pipe 40 is clear of the platform 111, as shown in FIG. 11, the winch is stopped and the tower 123 is rotated on rotary tables 136 and 137 by approximately 120 degrees, so that the section of drill pipe 40 is now in line with the first mousehole 120. The winch is operated to unwind the wireline 140 to lower the carriage 124 and the section of drill pipe 40 into the mousehole 120, such that the box 41*a* is at approximately one to four meters and preferably one to two meters above the platform 111, as shown in FIG. 12. Once the section of drill pipe 40 is in the mousehole 120, slips in the mousehole (not shown) or an end stop, such as a scabbard, underneath the drill pipe (not shown) prevent the drill pipe 40 from falling through the drilling rig 100. The winch continues to unwind a small distance to lower the elevator 1 so that the elevator 1 slides down the body 41 of the section of drill pipe 40, unseating itself from the upset of the box 41*a*. The winch is now stopped. The elevator 1 is close to the platform 111 and roughnecks remove the safety locking pin 55 from the elevator 1 and pull back on the handle 58 to release the jaws 12 and 13. The mechanism 60 facilitates disengagement of the jaws 12 and 13 from the drill pipe 40. The tower 123 is rotated to assume its original position and then the winch is operated to unwind the wireline 140. The elevator 1 tumbles down or is guided by roughnecks to the catwalk 128 where a second section of drill pipe 142 has been placed in the same fashion as the first.

The elevator 1 is latched on to the body 143 of the second section of drill pipe 142 in the same way as described above with reference to the first section of drill pipe 40 and the winch is operated to lift the elevator 1 and the second section of drill pipe 142 clear of the platform 111. The tower 123 is rotated approximately 90 degrees so that the second section of drill pipe 142 is aligned with the second mousehole 121. The winch is operated to unwind the wire line 140 to lower the second section of drill pipe 142 into the second mousehole 121, such that the upset 144 is at approximately one to four meters and preferably one to two meters above the platform 111. Slips in the mousehole (not shown) or an end stop underneath the drill pipe (not shown) prevent the drill pipe 40 from falling through the drilling rig 100. The winch continues to unwind a small distance to lower the elevator 1 so that the elevator 1 slides down the body 143 of the section of drill pipe 142, unseating itself from the upset 143. The winch is now stopped. The elevator 1 is close to the platform 111 and roughnecks remove the safety locking pin 55 from the elevator 1 and pull back on the handle 58 to release the jaws 12 and 13. The mechanism 60 facilitates disengagement of the jaws 12 and 13 from the drill pipe 40. The tower 123 is rotated to assume its original position and then the winch is operated to unwind the wireline 140. The elevator 1 tumbles down or is guided by roughnecks to the catwalk 128 where a third section of drill pipe 145 has been placed in the same fashion as the first.

Figure 13:
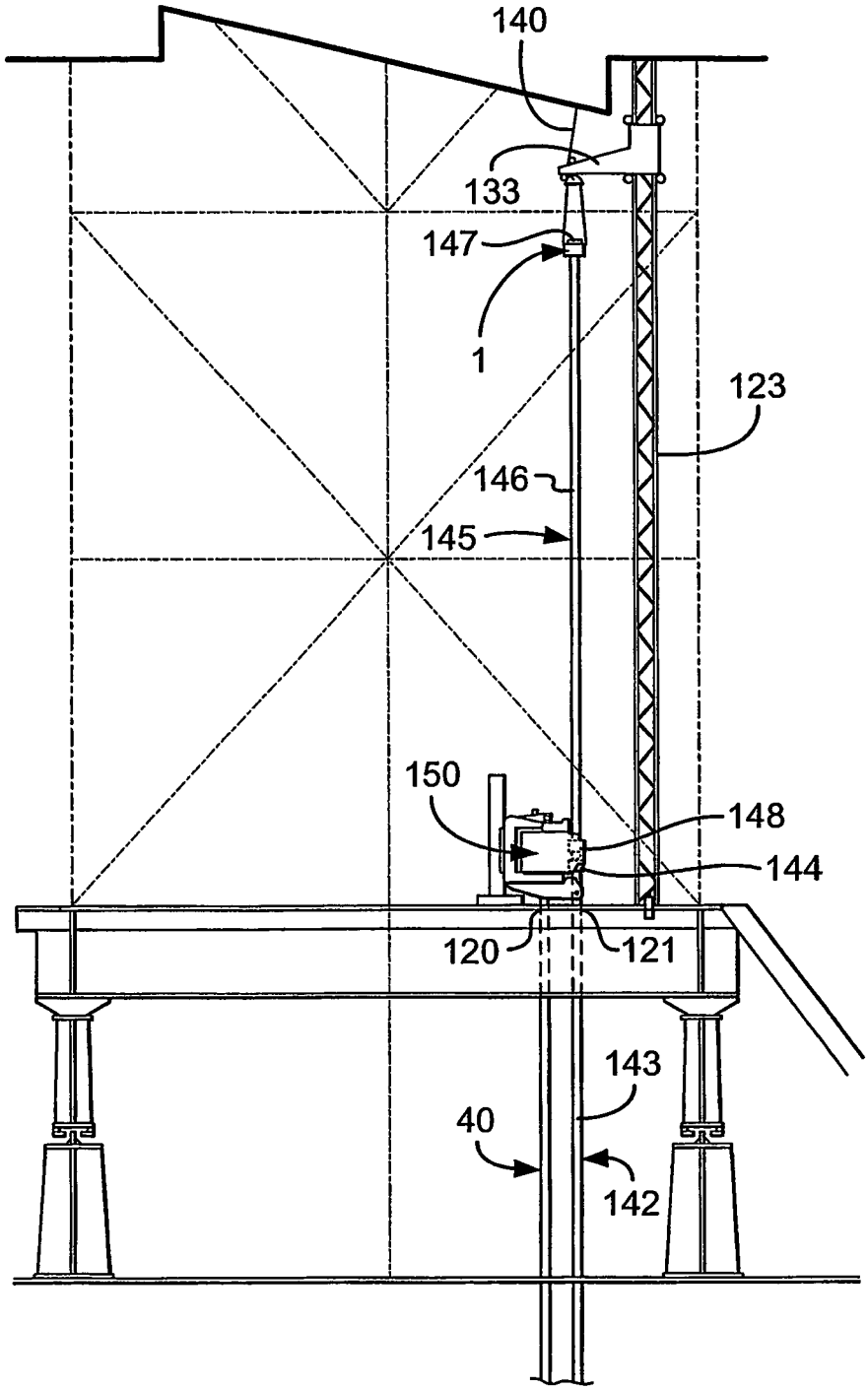
FIG. 13 is a schematic diagram of a side view of part of the drilling rig shown in FIG. 8, showing a fifth step in a method in accordance with the present invention.
Figure 14:
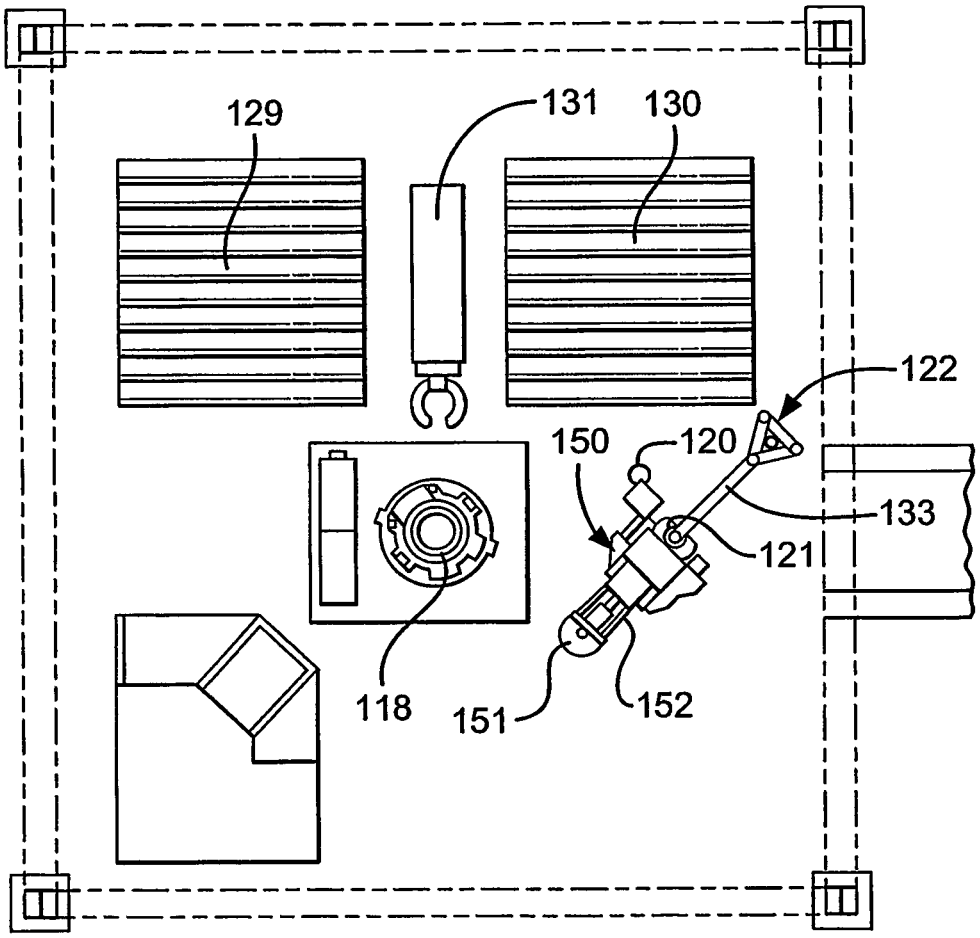
FIG. 14 is a schematic top view of the drilling rig shown in FIG. 8, showing the fifth step in the method, with further parts shown and other parts not shown.
Figure 15:
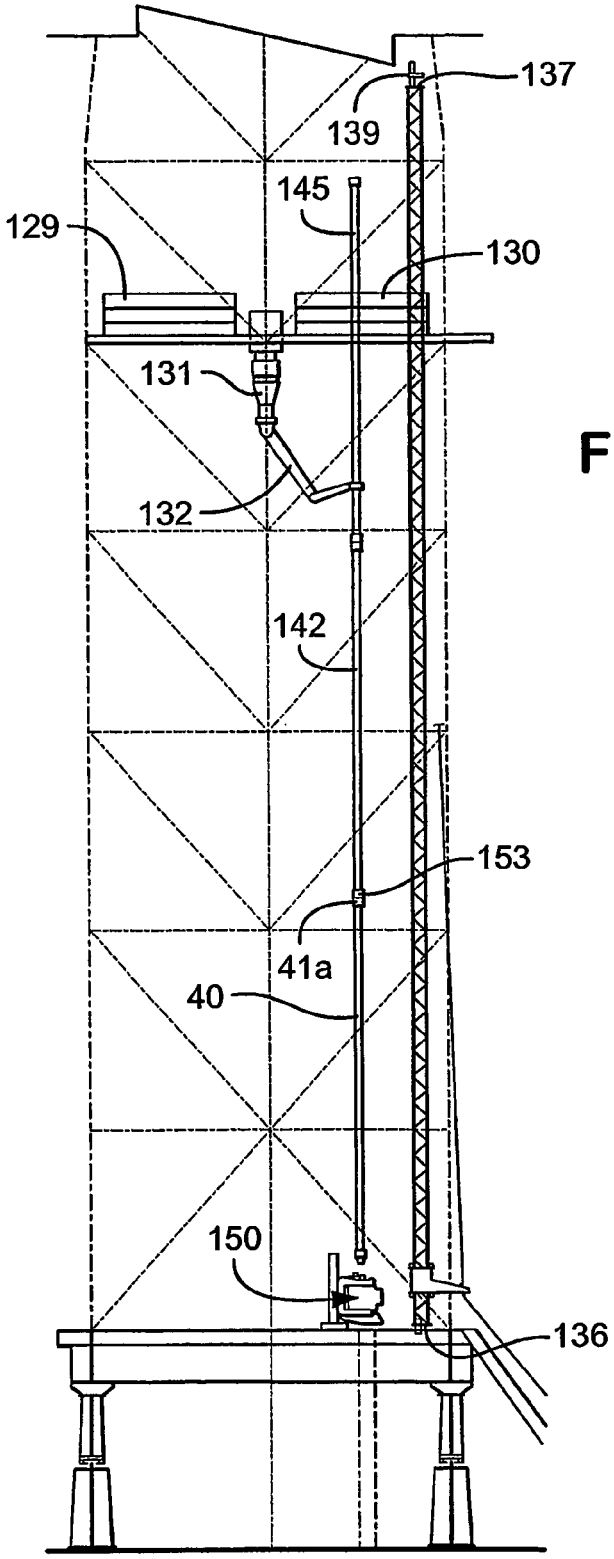
FIG. 15 is a schematic diagram of a side view of part of the drilling rig shown in FIG. 8, showing a sixth step in a method in accordance with the present invention.

The elevator 1 is latched on to the body 146 of the second section of drill pipe 145 in the same way as described above with reference to the first section of drill pipe 40 and the winch is operated to lift the elevator 1 and the third section of drill pipe 145 on the upset 147 at least one meter clear of the platform 111. The tower 123 is rotated approximately 90 degrees so that the third section of drill pipe 145 is aligned with the second mousehole 121. The winch is operated to unwind the wire line 140 to lower the third section of drill pipe 142 so that the pin end 148 of the third section of drill pipe 145 is in close proximity with the box 144 of the second section of drill pipe 142 located in the second mousehole 121. A spinning and torquing unit 150 known as an Iron Roughneck, such as the one sold by BJ Varco under the trade mark ST-80, is rotated about a pillar 151 into alignment with the second mousehole 121 and moved forward on an extendible arm 152 to engage the box 144 of the second section of drill pipe 142 and the pin end 148 of the third section of drill pipe 145. The winch may comprise a single joint compensator, such as a pneumatic piston (not shown) to allow the third drill pipe to be pulled down a few centimeters to allow the pin end 148 to be threaded into the box 144. Such a compensator is disclosed in PCT publication number WO 96/18799 Alternatively, the elevator 1 is lowered a small amount to allow the third section of drill pipe 145 to move downwards whilst the connection is made with the spinning and torquing unit 150, shown in FIG. 14. Dope may be applied to the threads of the pin and/or box before the connection is made. FIG. 13 shows the connection is made between the second 142 and third 145 sections of drill pipe to form a stand of two sections, known as a double.

The spinning and torquing unit 150 is retraced on arm 152 and swung about pillar 151 to a storage position, or to be used at the wellcentre 118. The winch is operated to wind the wireline 140 to lift the elevator 1 and the second 142 and third 145 sections of drill pipe up guided by the carriage 124 out of the second mousehole 121. The winch is then stopped and the tower 123 is rotated a further 30 degrees to align with the first mousehole 120. The winch is operated to lower a pin end 153 of the second section of drill pipe 142 is in close proximity with the box 41*a* of the first section of drill pipe 40 located in the first mousehole 120. The spinning and torquing unit 150 is rotated about a pillar 151 into alignment with the first mousehole 120 and moved forward on an extendible arm 152 to engage the box 41*a* of the first section of drill pipe 40 and the pin end 153 of the second section of drill pipe 142. The spinning and torquing unit 150 is activated to make-up the connection between the first 40 and second 142 sections of drill pipe to form a stand of three sections of drill pipe, known as a triple. Dope may be applied to the threads of the pin and/or box before the connection is made.

The spinning and torquing unit 150 is retraced on arm 152 and swung about pillar 151 to a storage position, or to be used at the wellcentre 118. The winch is operated to wind the wireline 140 to lift the elevator 1 and the triple i.e. the stand of first 40, second 142 and third 145 sections of drill pipe, is up guided by the carriage 124 out of the first mousehole 120. The tower 123 may be rotated towards a raised platform situated at the top of the fingerboards 129 and 130, known as a stabbing board or monkeyboard on which a derrickman stands. A pipe handling arm 131, such as the one sold by BJ Varco under the trade name VCR, grabs the triple. The derrickman on the stabbing board removes the safety locking pin 55 from the elevator 1 and pulls back on the handle 58 to release the jaws 12 and 13. The mechanism 60 facilitates disengagement of the jaws 12 and 13 from the drill pipe 40. The tower 123 is rotated to assume its original position and then the winch is operated to unwind the wireline 140. The elevator 1 tumbles down or is guided by roughnecks to the catwalk 128 where a third section of drill pipe 145 has been placed in the same fashion as the first. The pipe handling arm 131 holds and moves the triple into the fingerboard 129 or 130 for storage or moves the triple to the wellcentre 118 for connection to a string of drill pipe in the well. The spinning and torquing unit 150 is moved into alignment with the wellcentre for "just-in-time" stand building operations and moved on extendible arm 151 into engagement with the drill pipes to perfect a connection with the drill string.

In an alternative embodiment, in the elevator 1, the safety locking pin 55 is not used or is automated with a use of a stepper motor and the spring loaded locking member 46 is automated with the use of a hydraulic, pneumatic or electric actuating mechanism, then the derrickman need not be present to disconnect the elevator 1 from engagement with the triple and the operation of disconnecting the elevator from the triple once held by the pipe handling arm 131 can be conducted from the operator or driller's cabin.

Figure 16:
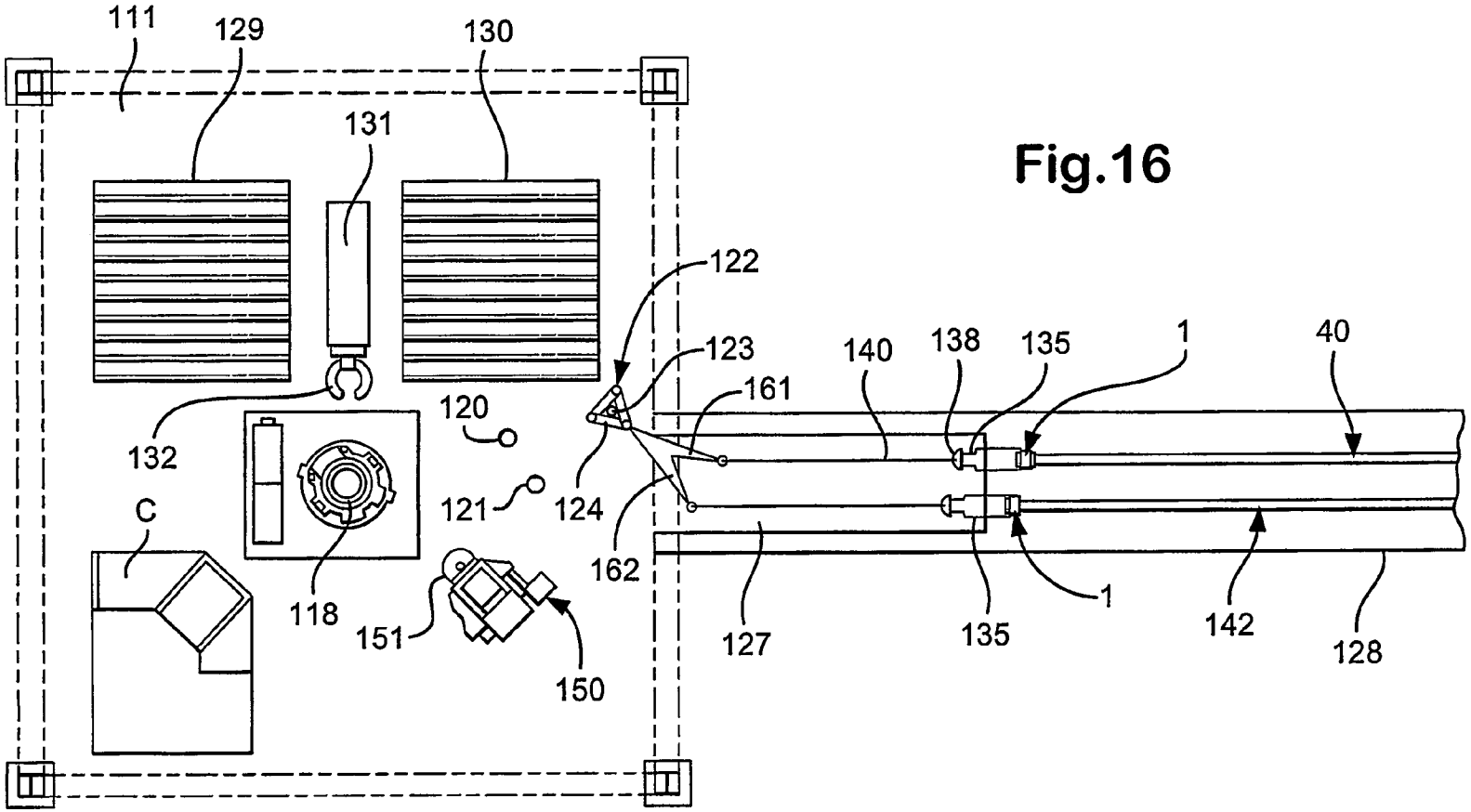
FIG. 16 is a schematic diagram of a top view of parts of a drilling rig of a further embodiment of the invention incorporating two apparatuses of the present invention.

A further embodiment of the present invention is shown in FIG. 16, which is generally similar to the embodiment of FIGS. 8 to 15. Similar parts to the parts shown in the preceding Figures are referenced with the same reference numerals. Two arms 161, 162 are provided on the carriage 124 in place of the one arm 133. Each arm 161 and 162 is provided with an elevator 1 or other gripping device. In use, the first and second sections of drill pipe 40 and 142 are hoisted in one operation rather than in two separate operations. The two arms are substantially the same length and the ends of the arms 161 and 162 define a circle or part circle about tower 123 when rotated. The arms define an angle therebetween of approximately 30 degrees, such that upon rotation of the tower 123, the ends of the arms 161 and 162 lie over the second 122 and first 121 mouseholes respectively. A third section of drill pipe may be handled with either arm 161 or arm 162 or a third and fourth section of drill pipe can be handled. The third for building a stand of three sections and the fourth for the first of a following stand building operation if a third mousehole is provided. Thus even faster assembly of stands of pipe at the preparation openings occur using the method of the present invention.

Drilling may be simultaneously conducted at the wellcentre 118 whilst preparation of a stand of pipe or a single is transferred from the catwalk 128 or ramp 127 to the wellcentre 118 and/or fingerboard, as described herein.

Although the above description of the preferred embodiments has focused on double preparation opening rigs, if one preparation opening is used the pipe handling apparatus may be used to build a double.

By using a different elevator, such as a slip type elevator, it is also possible using the method of the invention to put together tubulars and downhole tools which do not have upset portions such as boxes or collars.

Although the above description has been discussed with relation to a single pipe handling arm 131, it should be understood that the enhanced capabilities of the multi-armed device may be utilized for the offline standbuilding activities described above.

After a certain drilling period the bottomhole assembly has to be replaced, which means that the drill string must be tripped out of the well through the wellcentre 118. The drill string is then disconnected into drill string stands in a reverse process to that described above, and the drill stands are stored in the storage areas 129 and 130. As described above, the new bottom hole assembly may have been prepared beforehand using the pipe handling apparatus 122.

The present invention, therefore, provides in some, but not in necessarily all, embodiments an elevator having an elevator body with two opposed ends, an open throat between the two opposed ends, the body having a mid-portion spaced-apart from the two opposed ends, two jaws, each jaw pivotably connected to one of the two opposed ends, each jaw pivotable to a gripping position for gripping a tubular, latch apparatus at the mid-portion of the elevator body, the latch apparatus selectively movable with respect to the elevator body for selective engagement of the two jaws, and the latch apparatus including a latch body movable to releasably hold the two jaws in the gripping position. Such an elevator may one or some, in any possible combination, of the following: latch lock apparatus for selectively locking the latch body with the two jaws in the gripping position to prevent release of the two jaws from gripping the tubular; wherein the latch lock apparatus includes a latch pin, a latch pin hole in the elevator body, and a body hole in the latch body, the latch pin insertable exteriorly of the elevator body through the latch pin hole and into the body hole upon alignment of the member hole with the latch pin hole as the jaws move to push the latch body; wherein each jaw of the two jaws has a latch recess, the latch body has two spaced-apart latch lips, each latch lip disposed for releasable receipt within a corresponding latch recess of one of the two jaws for releasably holding said jaw in the gripping position; latch handle apparatus including a latch shaft connected to the latch body, the latch shaft having a portion projecting through a corresponding hole in the elevator body, a latch handle connected to the latch shaft, the latch handle located outside the elevator body, the latch handle manipulable to move the latch shaft and the latch body to release the latch body from the two jaws thereby releasing the jaws from gripping the tubular; releasably urging means in the elevator body contacting the latch body and urging the latch body toward the two jaws and for releasably maintaining the two jaws in the gripping position; two jaw positioners, each movably located on one of the jaws for contacting said one of the two jaws in a tubular gripping position; wherein each jaw of the two jaws has a position recess for releasable receipt therein of a portion of one of the two jaw positioners; wherein each jaw positioner includes a positioner body pivotably connected to a corresponding jaw, each jaw positioned has a portion disposed for movement along a surface of the housing to facilitate jaw movement; wherein each jaw positioner has roller apparatus for rolling along a corresponding housing surface and for facilitating entry of a portion of the positioner into a positioner recess; wherein each jaw of the two jaws has a tapered edge; wherein each jaw of the two jaws is held in place by a removable hinge pin for facilitating jaw removal and replacement; wherein each jaw of the two jaws has a jaw body portion sized and configured for accommodating a range of tubulars of different diameters; wherein each jaw of the two jaws has a jaw body with a pivot hole therethrough, each jaw pivotably connected to the elevator body with a connector extending through the pivot hole, the pivot hole located so that the jaws are movable to an open non-gripping position when the elevator is raised to a position in which the mid-portion is above the two spaced-apart ends; and/or wherein the elevator is positionable above a tubular which is generally horizontal with the two jaws in a jaw-open position, the elevator lowerable onto the tubular for gripping the tubular, the elevator further including two spaced-apart end lifting eyes, each end lifting eye on one of the two opposed ends of the elevator body, and a mid-lifting eye located adjacent the mid-portion of the elevator body, the mid-lifting eye disposed so that a support line connected to the mid-lifting eye holds the elevator in position above the tubular with the two jaws in the jaw-open position and the end lifting eyes located so that using support lines connected thereto the elevator can be lifted with a gripped tubular from the generally horizontal position to a non-horizontal position for further operations.

The present invention, therefore, provides in some, but not in necessarily all, embodiments an elevator having an elevator body with two opposed ends, an open throat between the two opposed ends, the body having a mid-portion spaced-apart from the two opposed ends, two jaws, each jaw pivotably connected to one of the two opposed ends, each jaw pivotable to a gripping position for gripping a tubular, latch apparatus at the mid-portion of the elevator body, the latch apparatus selectively movable with respect to the elevator body for selective engagement of the two jaws, the latch apparatus including a latch body movable to releasably hold the two jaws in the gripping position, latch lock apparatus for selectively locking the latch body with the two jaws in the gripping position to prevent release of the two jaws from gripping the tubular, each jaw of the two jaws having a latch recess, the latch body having two spaced-apart latch lips, each latch lip disposed for releasable receipt within a corresponding latch recess of one of the two jaws for releasably holding said jaw in the gripping position, releasably urging means in the elevator body urging the latch body toward the two jaws and releasably maintaining the two jaws in the gripping position, and each jaw of the two jaws held in place by a removable hinge pin for facilitating jaw removal and replacement.

The present invention, therefore, provides in some, but not in necessarily all, embodiments methods for gripping a tubular, the method including positioning an elevator adjacent a tubular, the elevator as any disclosed herein according to the present invention.

The present invention, therefore, provides in some, but not in necessarily all, embodiments a system for handling tubular body sections at a drilling site including a drill platform having a derrick extending upwards therefrom, the drill platform and derrick defining a drill area, a first hoist connected to an upper part of the derrick for passing a tubular body through a drilling opening defined in the drill platform, at least one storage area being arranged within the drill area for storing a plurality of tubular lengths, each of the tubular lengths having at least two releasably interconnected tubular body sections, at least one preparation opening extending through the drill platform at a location spaced from the drilling opening and from the at least one storage area, a torquing tool for rotatably interconnecting tubular bodies at the at least one preparation opening to form tubular lengths, a first pipehandling device for transporting tubular bodies and tubular lengths from outside the drill area to the at least one preparation opening, said first pipehandling device having at least two separate gripping devices for independently gripping separate tubulars simultaneously, the two separate gripping devices including a first gripping device and a second gripping device, a second pipehandling device for transporting tubular lengths between the at least one preparation opening, the at least one storage area, and the first hoist, and the first gripping device having an elevator, the elevator having an elevator body with two opposed ends, an open throat between the two opposed ends, the body having a mid-portion spaced-apart from the two opposed ends, two jaws, each jaw pivotably connected to one of the two opposed ends, each jaw pivotable to a gripping position for gripping a tubular, latch apparatus at the mid-portion of the elevator body, the latch apparatus selectively movable with respect to the elevator body for selective engagement of the two jaws, and the latch apparatus including a latch body movable to releasably hold the two jaws in the gripping position.

The present invention, therefore, provides in some, but not in necessarily all, embodiments a method for manipulating tubular body sections at a drilling site including providing a tubular handling system including a drill platform having a derrick extending upwards therefrom, the drill platform and derrick defining a drill area, a first hoist connected to an upper part of the derrick for passing a tubular body through a drilling opening defined in the drill platform, at least one storage area being arranged within the drill area for storing a plurality of tubular lengths, each of the tubular lengths comprising at least two releasably interconnected tubular bodies, at least one preparation opening extending through the drill platform at a location spaced from the drilling opening and from the at least one storage area, a torquing tool for rotatably interconnecting tubular bodies at the at least one preparation opening to form tubular lengths, a first pipehandling device having at least two separate gripping devices for independently gripping separate tubulars simultaneously for transporting tubular bodies and tubular lengths from outside the drill area to the at least one preparation opening, the two separate gripping devices including a first gripping device and a second gripping device, the first gripping device having an elevator, the elevator having an elevator body with two opposed ends, an open throat between the two opposed ends, the body having a mid-portion spaced-apart from the two opposed ends, two jaws, each jaw pivotably connected to one of the two opposed ends, each jaw pivotable to a gripping position for gripping a tubular, latch apparatus at the mid-portion of the elevator body, the latch apparatus selectively movable with respect to the elevator body for selective engagement of the two jaws, and the latch apparatus including a latch body movable to releasably hold the two jaws in the gripping position, a second pipehandling device for transporting tubular lengths between the at least one preparation opening, the at least one storage area, and the first hoist, transporting a plurality of tubular bodies from outside the drill area to the at least one preparation opening in a substantially vertical position by means of the at least two gripping devices of the first pipehandling device, forming a tubular length by releasably interconnecting a plurality of tubular bodies with the torquing tool, while a first tubular body of the tubular bodies extends through the preparation opening and a second tubular body is gripped by the first gripping device of the first pipehandling device, and withdrawing the prepared tubular length from the preparation opening by means of said first pipehandling device, transporting the prepared tubular length to the at least one storage area in a substantially vertical position by means of said second pipehandling device, transporting tubular lengths from the storage area to the drilling opening in a substantially vertical position by means of said second pipehandling device, and releasably connecting said tubular lengths to the upper end of a drill stem suspended within the drilling opening with the torquing tool to form a completed drill stand, and successively lowering the drill stand through the drilling opening by means of said first hoist.

Such an apparatus may have an elevator with a tapered edge to facilitate accommodation of a tubular by the elevator.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes.

The present invention provides an apparatus for moving pipe on a rig floor between a number of different stations including an off-floor rack, a preparation opening, a borehole, and a storage area, such that tubulars can be loaded onto the drill floor, prepared at the preparation opening loaded onto or off of the storage rack, and connected to a drill string while drilling is simultaneously conducted at the borehole.

The invention claimed is:

1. An apparatus that is adapted for handling pipe, the apparatus comprising:

a body, said body defining an open throat that is adapted to receive a pipe;

a plurality of jaws that are adapted to engage a pipe while preventing said pipe from engaging said body, wherein each of said plurality of jaws is hingedly mounted to said body and wherein each of said jaws defines a concave portion that is adapted to engage said pipe; and respective over-center mechanisms that are arranged between and operatively coupled to said body and each one of said plurality of jaws, wherein each respective over-center mechanism is adapted to inhibit a respective one of said plurality of jaws from closing when said plurality of jaws are open, and wherein each of said respective over-center mechanisms is further adapted to inhibit a respective one of said plurality of jaws from opening and disengaging from a pipe when said plurality of jaws are closed on said pipe.

2. The apparatus of claim 1, wherein the body is generally horseshoe shaped and said open throat is defined by said horseshoe shaped body.

3. The apparatus of claim 1, wherein at least one of said plurality of jaws is adapted to be at least partly rotatable within the open throat.

4. The apparatus of claim 1, wherein each of said plurality of jaws is hingedly mounted to said body on a respective hinge pin.

5. The apparatus of claim 4 wherein each respective hinge pin is removable from said body.

6. The apparatus of claim 5 wherein each respective hinge pin is removably coupled to said body using a locking pin.

7. The apparatus of claim 1, further comprising a locking member that is adapted to inhibit rotation of each of said plurality of jaws.

8. The apparatus of claim 7, wherein said plurality of jaws comprises two jaws, and wherein said locking member is arranged between the two jaws.

9. The apparatus of claim 7 wherein said locking member is retractable.

10. The apparatus of claim 7 wherein the locking member is arranged on at least one spring.

11. The apparatus of claim 7 wherein the locking member comprises a handle by which the locking member is retractable.

12. The apparatus of claim 7, further comprising a safety device that is adapted to maintain the locking member in a locked position when said plurality of jaws are engaged with a pipe.

13. The apparatus of claim 12 wherein said safety device comprises a first indicator on said locking member and a second indicator in the body, wherein alignment of said first and second indicators is adapted to indicate that the locking member is in said locked position.

14. The apparatus of claim 13 further comprising a safety locking pin, wherein said first indicator on said locking member is a first hole and the second indicator on said body is a second hole, and wherein the safety locking pin is adapted to be inserted through said first and second holes when they are aligned with one another.

15. The apparatus of claim 1, the body further comprising a respective seat for each of said plurality of jaws to abut when said plurality of jaws are engaged with a pipe.

16. The apparatus of claim 1 wherein the over-center mechanism comprises a pin and a spring guide that is adapted to be rotated about said pin, and a spring that is adapted to be compressed in the spring guide upon movement of a respective one of said plurality of jaws.

17. The apparatus of claim 1, further comprising at least one handle on the apparatus for carrying and applying the apparatus to a pipe.

18. The apparatus of claim 1, wherein the apparatus comprises an elevator.

19. The apparatus of claim 1, wherein said plurality of jaws are adapted to engage a pipe when said pipe is lying on a floor, and wherein said apparatus is adapted to lift said engaged pipe from said floor.

20. The apparatus of claim 19, wherein said apparatus is adapted to lift a pipe that has been engaged by said plurality of jaws from a substantially horizontal position to a substantially vertical position.

21. The apparatus of claim 1, wherein said concave portion of each of said plurality of jaws is a substantially arcuate shape that subtends a portion of a circle.

22. The apparatus of claim 21, wherein said portion of said circle comprises at least 20 degrees of said circle.

23. The apparatus of claim 21, wherein said portion of said circle comprises at least 140 degrees of said circle.

24. The apparatus of claim 1, wherein each of said plurality of jaws comprises a tapered edge portion that is adapted to engage an upset portion of a pipe.

25. The apparatus of claim 1, wherein said plurality of jaws is a first removable plurality of jaws that are adapted to engage a first pipe having a first diameter, and wherein said first removable plurality of jaws are adapted to be removed from said body and replaced with a second removable plurality of jaws that are adapted to engage a second pipe having a second diameter.

26. An apparatus that is adapted for handling pipe, the apparatus comprising:

a body, said body defining an open throat that is adapted to receive a pipe;

a plurality of jaws that are adapted to engage a pipe while preventing said pipe from engaging said body, wherein each of said plurality of jaws is hingedly mounted to said body and wherein each of said jaws defines a concave portion that is adapted to engage said pipe;

a locking member that is adapted to inhibit rotation of each of said plurality of jaws;

a safety device that is adapted to maintain the locking member in a locked position when said plurality of jaws are engaged with a pipe, said safety device comprising a first hole on said locking member and a second hole in the body, wherein alignment of said first and second holes is adapted to indicate that the locking member is in said locked position; and a safety locking pin that is adapted to be inserted through said first and second holes when they are aligned with one another.

27. An apparatus that is adapted for handling pipe, the apparatus comprising:

a body, said body defining an open throat that is adapted to receive a pipe;

a plurality of jaws that are adapted to engage a pipe while preventing said pipe from engaging said body, wherein each of said plurality of jaws is hingedly mounted to said body and wherein each of said jaws defines a concave portion that is adapted to engage said pipe;

a respective resilient means arranged between the body and each one of said plurality of jaws, wherein at least one of the respective resilient means comprises an over-center mechanism, said over-center mechanism comprising:

a pin;

a spring guide that is adapted to be rotated about said pin; and a spring that is adapted to be compressed in the spring guide upon movement of a respective one of said plurality of jaws.

* * * * *